US006463600B1

(12) United States Patent
Conway et al.

(10) Patent No.: US 6,463,600 B1
(45) Date of Patent: Oct. 15, 2002

(54) AUTOMATIC SHOWER AND BATHTUB CLEANER

(76) Inventors: Daniel P. Conway, 209 McCormack Rd. North, Slingerlands, NY (US) 12159; Jude Nicholas Kaiser, 12 Sheldon Ave., Troy, NY (US) 12180

( * ) Notice: Subject to any disclaimer, the term of this patent is extended or adjusted under 35 U.S.C. 154(b) by 0 days.

(21) Appl. No.: 09/848,154

(22) Filed: May 4, 2001

(51) Int. Cl.[7] ..... E03D 9/00
(52) U.S. Cl. ..... 4/662; 4/546; 222/325
(58) Field of Search ..... 4/546, 597, 662; 222/63, 325, 333, 643

(56) References Cited

U.S. PATENT DOCUMENTS 3,713,176 A * 1/1973 Stock ..... 4/662
4,233,692 A * 11/1980 Sinsley ..... 4/662
5,836,482 A * 11/1998 Ophardt et al. ..... 222/325
6,279,836 B1 * 8/2001 Toetschinger et al. ..... 239/70

* cited by examiner

*Primary Examiner*—Robert M. Fetsuga
(74) *Attorney, Agent, or Firm*—Thomas M. Owens, Esq.

(57) ABSTRACT

An automatic shower and bathtub cleaning device, with no connection to the water supply piping, that directs cleaning fluid through nozzles that are positioned or adjusted to allow coverage of the entire inside surface of the shower or bathtub enclosure. The device consists of a main body, cleaning fluid reservoir, electric pump, nozzles, and a control circuit that allows either local or remote initiation of the device's cleaning cycle operation.

15 Claims, 21 Drawing Sheets

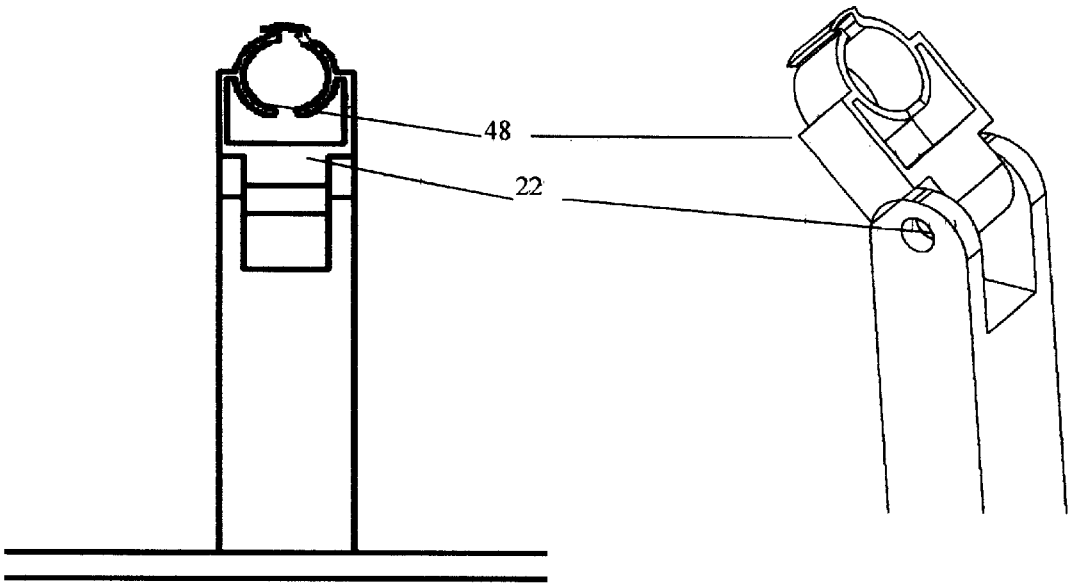
FIG. 3A
FIG. 3B
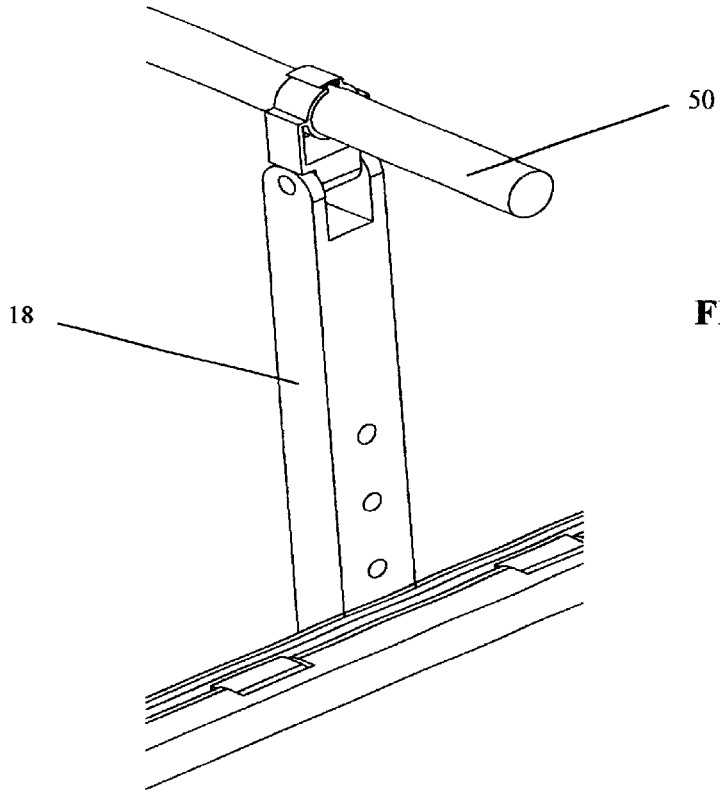
FIG. 3C

AUTOMATIC SHOWER AND BATHTUB CLEANER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field Of The Invention

The present invention relates to a new and novel apparatus for cleaning showers and bathtubs.

2. Background Information

The surfaces of showers and bathtubs collect soap scum and are susceptible to the buildup of mold and mildew. Due to health and sanitary concerns, such surfaces often require daily cleaning.

In the past, the task of cleaning such surfaces has nearly exclusively been accomplished by application of a cleaner and scrubbing by hand. As a result of the increasing cost of manual labor, attempts have been made to improve the cleaning operation of these showers and bathtubs. Such attempts have included the design of complicated cleaning systems that connect to, and draw water from, the piping system that supplies water to the shower or bathtub.

Representative U.S. patents showing apparatus for cleaning shower or bathtub surfaces are: U.S. Pat. Nos. 3,230,550; 4,383,341; 4,872,225; 4,974,310; 5,431,180; 5,452,485.

In U.S. Pat. No. 3,230,550, the invention consisted of a shower stall which used nozzles located along the floor of a shower to clean the bottom surface of the shower. U.S. Pat. Nos. 4,383,341 and 4,974,310 involved a series of spring-loaded nozzles located along the walls of the bathtub that are connected to the water supply piping to spray the sides of the bathtub. In U.S. Pat. No. 4,872,225, the cleaning system used a pipe with nozzles, connected to the water supply header and arranged in a closed-loop configuration in the upper portion of the shower enclosure, to spray liquid against the surface of the shower enclosure. In U.S. Pat. No. 5,431,180, the invention prevented the inadvertent introduction of disinfectant into the water supply piping in a cleaning system that utilized the existing water mains in a shower or bathtub. In U.S. Pat. No. 5,452,485, the invention was a gliding tub and shower device that utilized brushes that were positioned along a movable track to scrub the walls of the tub or shower.

However, these systems have not gained commercial acceptance due to their expense and cumbersome installation and use. In particular, each of the inventions previously discussed requires a connection to the existing shower or bathtub water supply piping. Accordingly, there is an unsolved need for a self-cleaning system which is economical, easy to install, and easy to use for cleaning showers and bathtubs and which does not require any connection to the water supply system for the shower or bathtub.

BRIEF SUMMARY OF THE INVENTION

In view of the foregoing disadvantages inherent in the existing apparatus for cleaning bathtubs and showers, the present invention provides an apparatus that is easy and economical to use and requires no connection to the water supply piping of the bathtub or shower.

The present invention will automatically spray clean the walls of a bathtub or shower enclosure. The invention discharges cleaning fluid through nozzles that are either adjusted or positioned for optimum surface coverage. The main body of the invention can be hidden from view or positioned in the shower or bathtub enclosure such that it is visible to the user. The invention will run for several cleaning cycles before it needs any refilling of cleaning fluid. The invention can be actuated locally or by remote means.

It is a first object of the invention to provide an apparatus that will automatically clean a bathtub or shower stall without the arduous hand labor that is normally involved.

Another object of the invention is to eliminate the expensive and time-consuming hand labor that is typically involved in the cleaning and sanitation of a bathtub and shower enclosure.

It is a further object of the invention to have a device that can be installed as an integral part of a new bathtub or shower enclosure or easily and cheaply installed as a retrofit into existing bathtubs or shower enclosures.

It is a further object of the invention to have a cleaning device that is easy to install and operate, with low maintenance, and able to operate for several cycles before requiring human intervention.

BRIEF DESCRIPTION OF THE SEVERAL VIEWS OF THE DRAWINGS

FIG. 3A shows a front view of the adjustable mounting arm with quick snap attachment mechanism (embodiment 1)

FIG. 3B shows an oblique view of the adjustable mounting arm with quick snap attachment mechanism in a pivoted position (embodiment 1)

FIG. 3C shows an oblique view of the adjustable mounting arm with quick snap attachment mechanism attached to a pipe (embodiment 1)

REFERENCE NUMERALS IN DRAWINGS

Figures 1A, 1B, 1C:
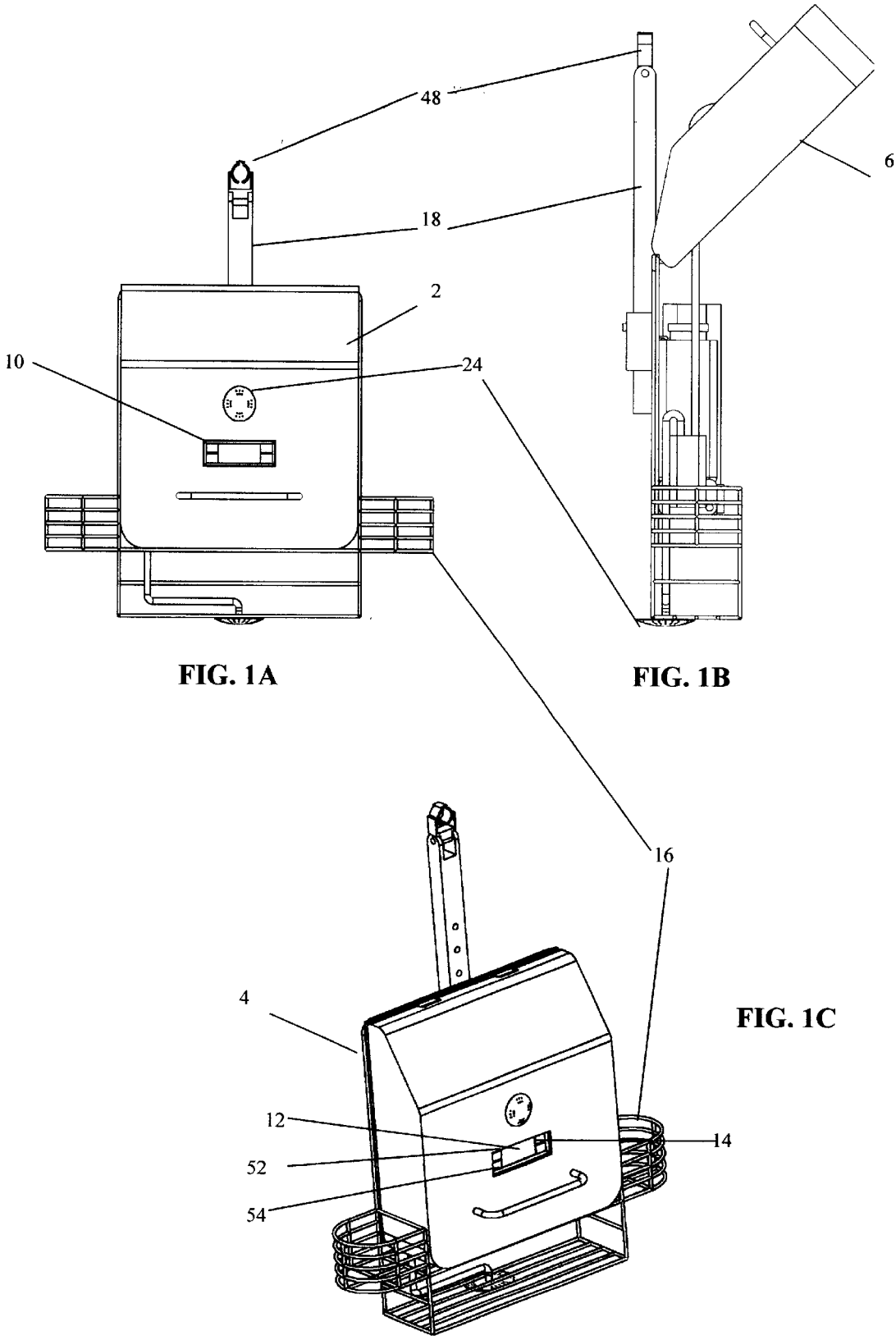
FIG. 1A shows front view of the automatic shower and tub cleaner (embodiment 1)
FIG. 1B shows view of the automatic shower and tub cleaner from the side with the main housing in the up position (embodiment 1)
FIG. 1C: shows an oblique view of the automatic shower and tub cleaner (embodiment 1)

1 Main Body
2 Stationary Part of Main Body
4 Wire Frame
6 Hinged Front of Main Body
8 Locking Hinges
10 Waterproof Operator Interface panel
12 Digital Clock
14 Push Buttons
16 Wire Baskets
18 Adjustable Mounting Arm
20 Spring Loaded Latching Mechanism
22 Flex Mechanism
24 Nozzle Assembly
26 Nozzles
28 Flexible Tubing
30 Indentations
32 Internal Reservoir
33 External Reservoir
34 Reservoir Cap with Lanyard
36 Spring-loaded Valve assemble
38 Reservoir guide/receptacle
40 Reservoir Latch
42 DC Electric Pump
44 DC Rechargeable Battery
46 Battery Socket
47 DC rechargeable battery and waterproof socket
48 Quick Snap Attachment Mechanism
50 Shower Faucet
51 Relay coil and contact
52 Piezo-electric buzzer
53 Wireless remote transmitter
54 Passive Infrared detector
55 Wireless receiver
56 Controller board
58 Guide
60 Embodiment 2 main body without baskets and adjustable hanger
62 Flexible distribution tubing
64 Distributed perimeter distribution nozzles
66 Start/stop pushbutton(s)
68 Axially distributed nozzles
69 Internal distribution manifold
70 Adjustable end caps
72 Shower Curtain rod with nozzles
74 Embodiment 3 main body
76 Bulkhead feed through nozzles
78 Nozzle washer, gasket and nut assembly
80 Embodiment 4 factory installed cleaning unit main body
82 Waterproof data and video display/interface with touch screen capabilities
84 Reservoir fill port
86 Waterproof microphone/speaker/buzzer
88 120 volt AC power cable
90 Data/communication cables
92 Wireless communication antenna
94 Molded tub/shower surround
96 Sloped operator interface section with waterproof gasketing
98 Internal housing
100 Power supply, computer, communication and display driver chassis
102 Computer
104 Ac to Dc Power Supply
106 Reservoir/Pump Module
108 Reservoir neck
110 Reservoir/pump module
112 Chassis Connectors
114 Antenna wiring
116 Internal housing connectors
118 Factory installed cut outs for the bulkhead feed through nozzle
120 Factory cutout for access to the internal housing
122 Gasket for multi-media operator interface panel
124 Multi-media operator interface panel
126 Nozzle gasket
128 Existing tub/shower surround
130 Field cut out for bulkhead feed through nozzle

132 Field cut out to retrofit internal housing of cleaner in an existing tub/shower surround

134 Stationary Reservoir

136 Gasket for sloped operator interface section

DETAILED DESCRIPTION OF THE INVENTION

Referring to the drawings, front and side views of the automatic shower and bathtub cleaner are shown in FIGS. 1A, 1B, and 1C. The main body (1) of the cleaner consists of a housing that is supported by a wire frame (4). The front of the main body housing (6) is hinged (8) such that it can be opened allowing access to components found within the housing. On the front of the main body housing is a spray tight operating panel (10). The operating panel consists of a digital clock (12) and push buttons (14) providing operator interface such as start, stop, and clock settings. The wire frame is fashioned not only to support the main body housing, but also to provide suitable storage space for toiletries in the form of wire basket bottle holders (16).

An adjustable mounting arm (18) is attached to the frame of the main body. The adjustable mounting arm has a spring-loaded latching mechanism (20) that allows the user to adjust and set the position of the cleaner in the shower or bathtub. The adjustable mounting arm is designed to provide positive locking capabilities such that when the latching mechanism is engaged, the position of the adjustable mounting arm is securely established and sustained. The adjustable mounting arm has a flex mechanism (22) designed to flex in the direction normal to the wall it rests against allowing the cleaner to lie flush against the shower wall even if the point of attachment to the shower faucet (50) is not perpendicular to the wall.

In the center of the main body housing is a nozzle assembly (24). This assembly contains nozzles (26) that can be adjusted in such a manner to provide uniform spray coverage of an entire shower or bathtub. Two sets of nozzles (26) are incorporated in this assembly. One set is arranged to provide uniform coverage of a bathtub or a combination shower/bathtub while the second set is designed to cover a shower stall. The nozzle assembly is capable of being adjusted to direct liquid cleaning solution to flow through either set of nozzles.

A second nozzle assembly is located on the bottom of the main body frame. This second assembly sprays the wall on which the cleaner rests. This second nozzle assembly is snap fit to the frame and connected to the housing via tubing.

Figure 5A:
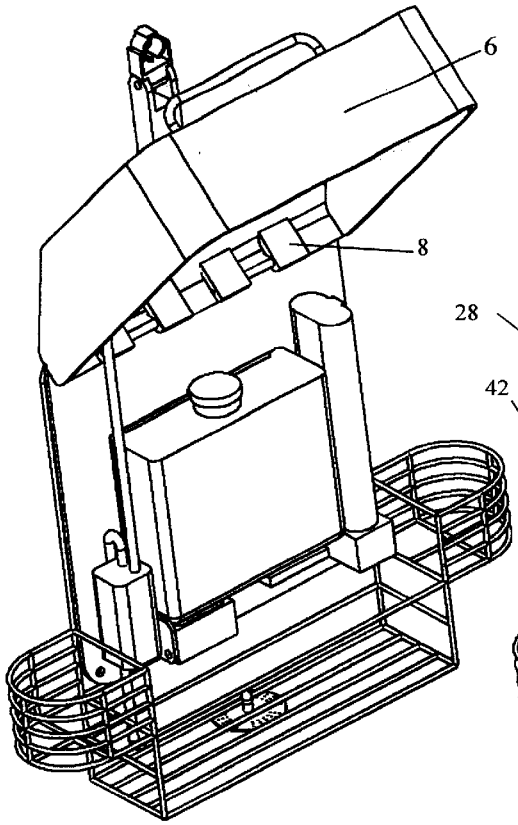
FIG. 5A is an oblique internal view of the automatic shower and tub cleaner's parts (embodiment 1)
Figure 8:
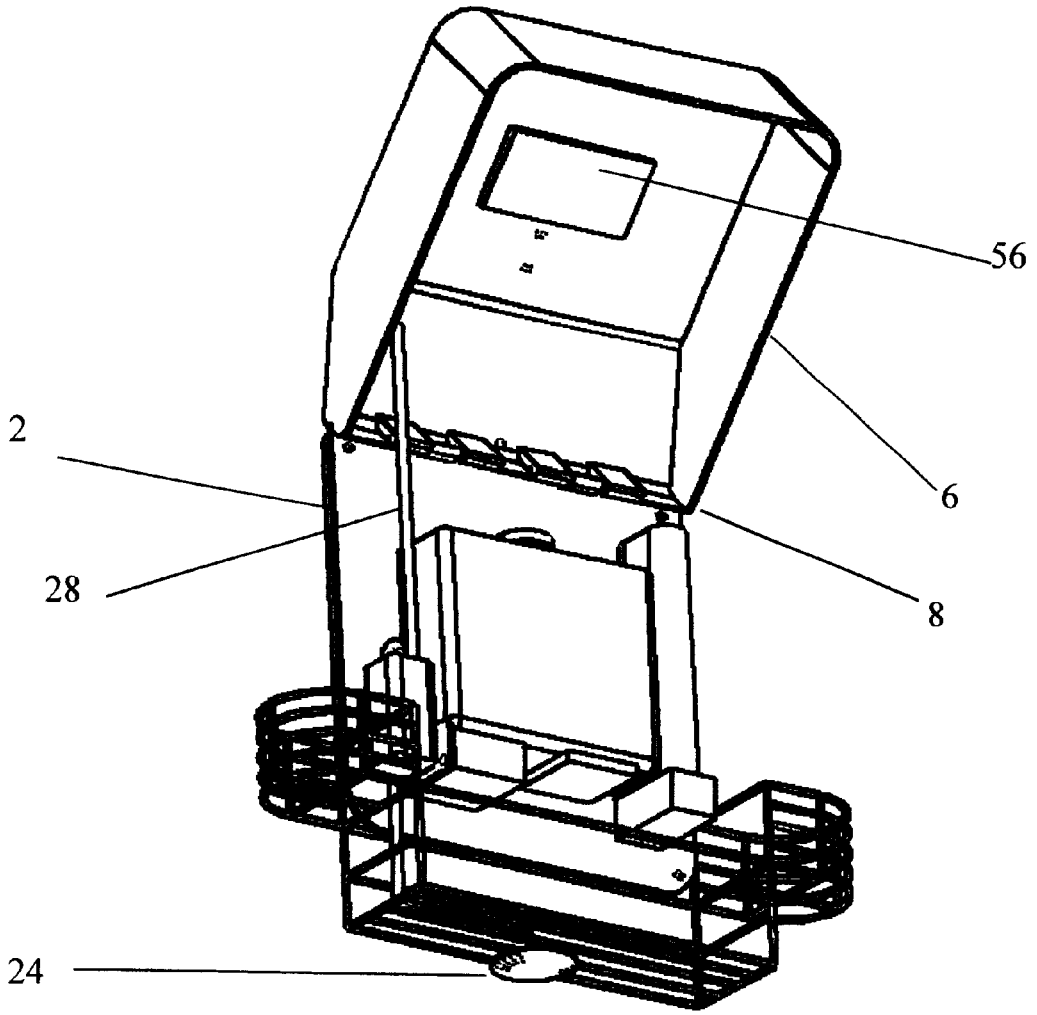
FIG. 8 is a view of internals including controller board placement (embodiment 1 and 2)

A rear view of the cleaner is shown in FIG. 2. The rear part of the main body housing is stationary (2) and connects to the frame (4) by snap fit. FIGS. 5A and 8 show locking hinges (8) used at the top of the stationary housing (2) allowing the front of the main body housing (6) to pivot upward allowing the user to access internal components. The hinges are designed such that once the front of the housing is raised in its upper most position, it is locked in that position until additional force is provided to release it from that position.

Figures 2A, 2B:
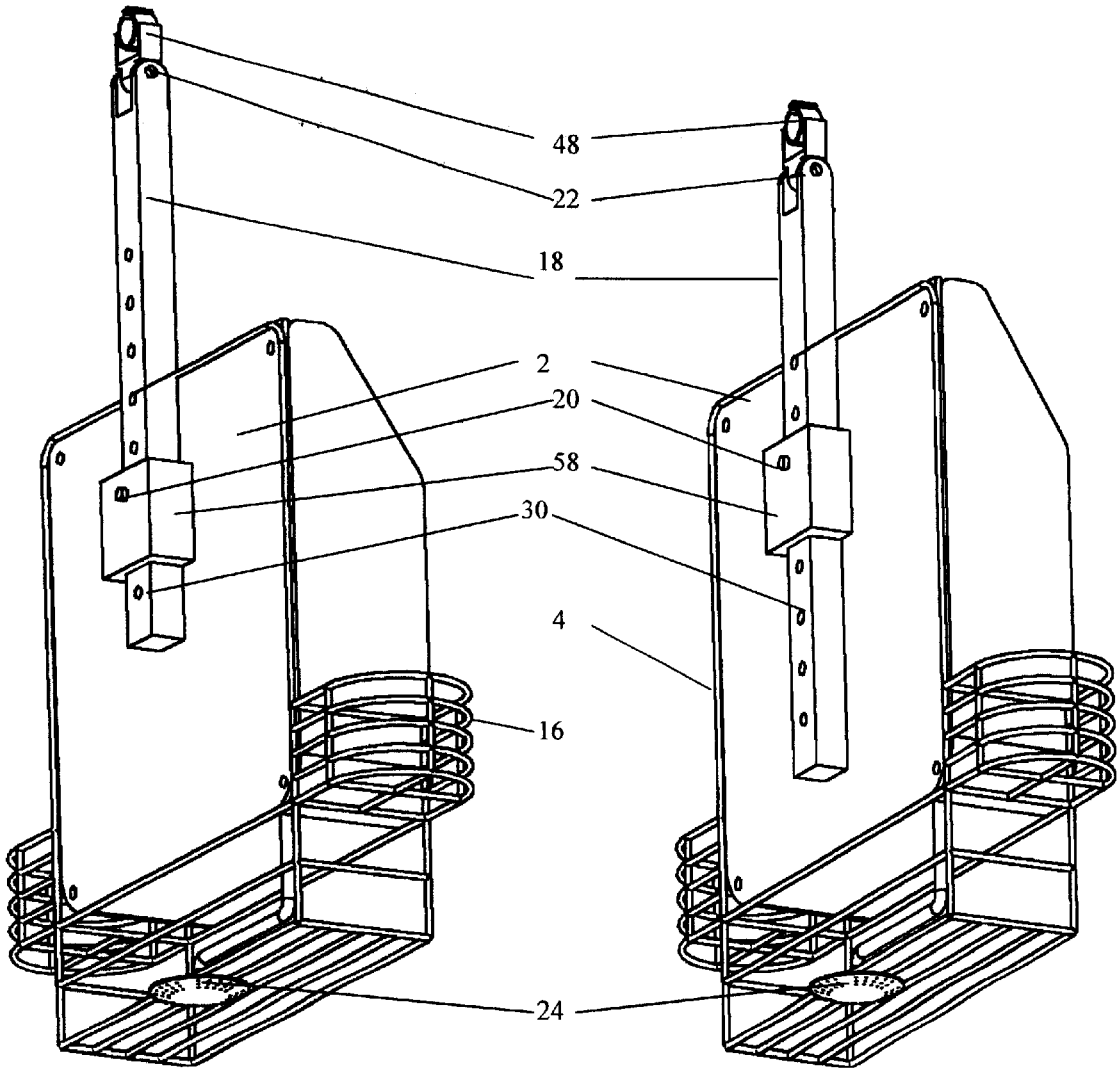
FIG. 2A: shows the back of the automatic shower and tub cleaner with its adjustable mounting arm in the extended position (embodiment 1)
FIG. 2B shows the back of the automatic shower and tub cleaner with its adjustable mounting arm in a detracted position (embodiment 1)
Figure 4A:
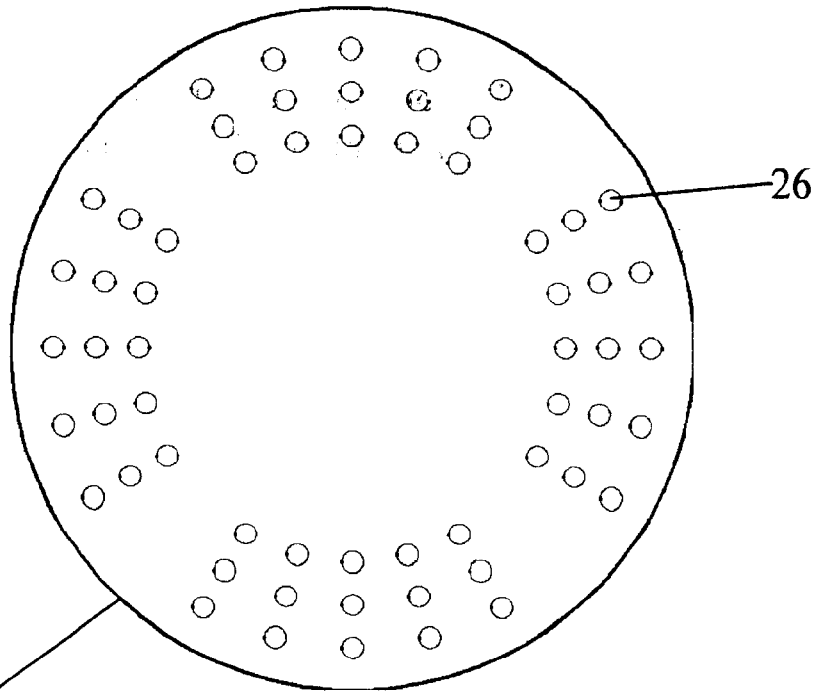
FIG. 4A is an top view of nozzle assemble
Figure 4B:
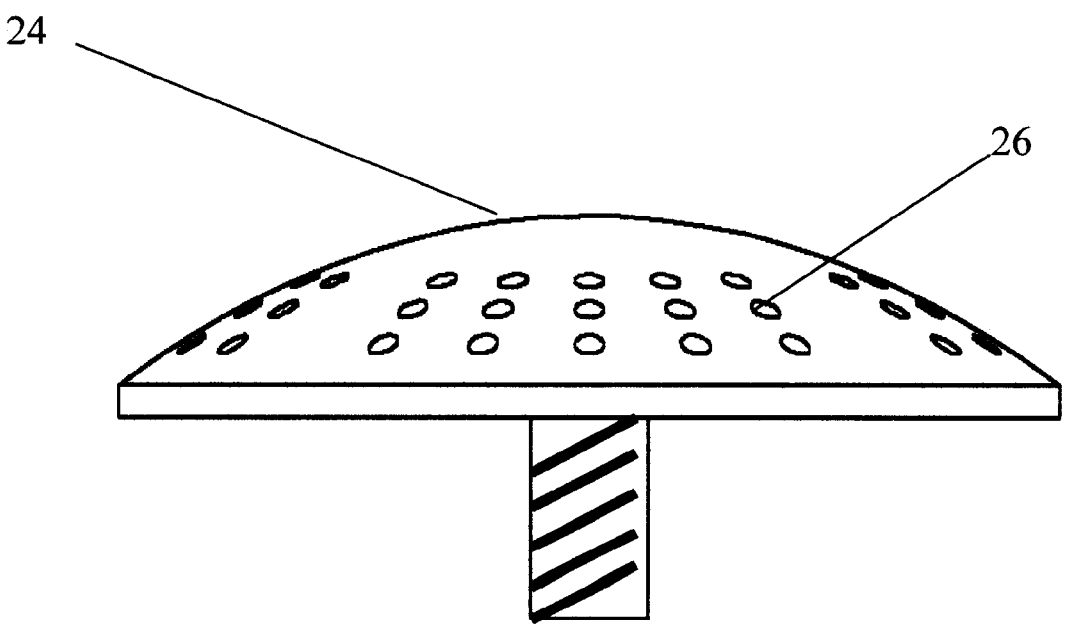
FIG. 4B is an side view of nozzle assemble (embodiment 1)

As shown in FIG. 2, the adjustable mounting arm (18) latching mechanism consists of a guide (58) with a spring loaded latch (20). Pushing on the spring-loaded latch allows the arm to move freely up or down within the guide. The adjustable mounting arm has evenly spaced indentations (30) such that upon release of the spring-loaded latch, the spring-loaded latch will engage an indentation preventing further movement of the arm. FIG. 2A shows the adjustable arm in an extended position while FIG. 2B illustrates the arm in a retracted position.

Figure 5B:
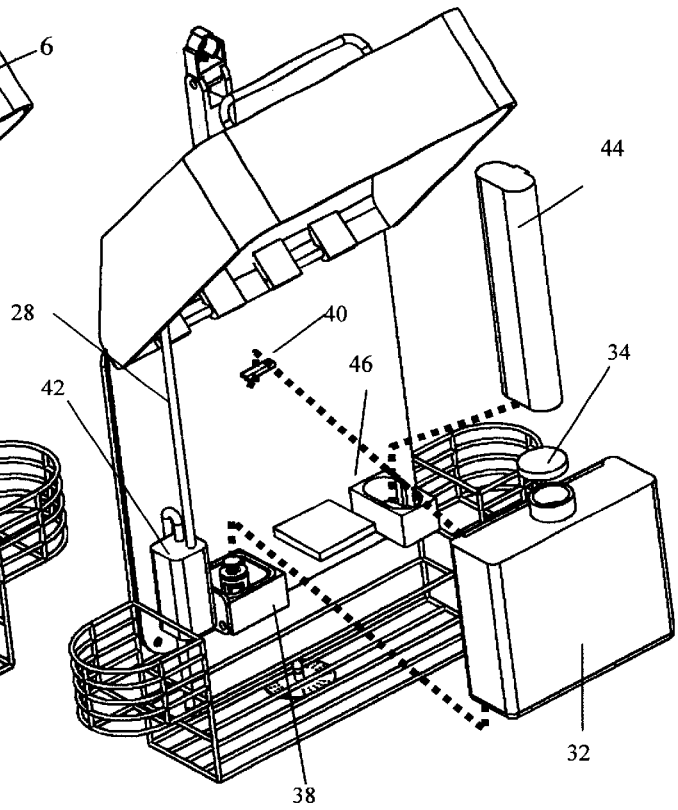
FIG. 5B is an oblique internal view of the cleaner showing exploded view of removable parts (embodiment 1)

The inside of the cleaner is shown in FIGS. 5A and 5B. The stationary main body housing (2) is formed to accept the internal components via snap fits to allow easy manufacturing. An internal reservoir (32), 32 fluid ounces in capacity, is designed to be easily removable from the cleaner for refilling of cleaning fluid. The reservoir is constructed of lightweight translucent plastic allowing fluid level indication. A plastic cap (34) is snap fit to the opening of the reservoir and thereby sealing the reservoir. The plastic cap is secured to the neck of the reservoir opening with a lanyard to avoid misplacing the cap while refilling the reservoir.

Located on the bottom of the reservoir (see FIG. 6) is a spring-loaded valve assembly (36). When the reservoir is removed from its locked position in the main body housing, the valve automatically shuts preventing inadvertent leakage of fluid from the reservoir (see FIG. 7A). When the reservoir is inserted into its locked position in the main body housing, the valve opens (see FIG. 7B) allowing fluid to flow into the distribution tubing and pump inlet. As shown in FIG. 5A, the stationary main body housing is formed to guide and align the reservoir and the spring-loaded valve assembly in place for proper engagement. Latches (40) near the top of the reservoir secures the reservoir to the main body housing ensuring a leak proof seal as shown in FIG. 5B.

Figure 6:
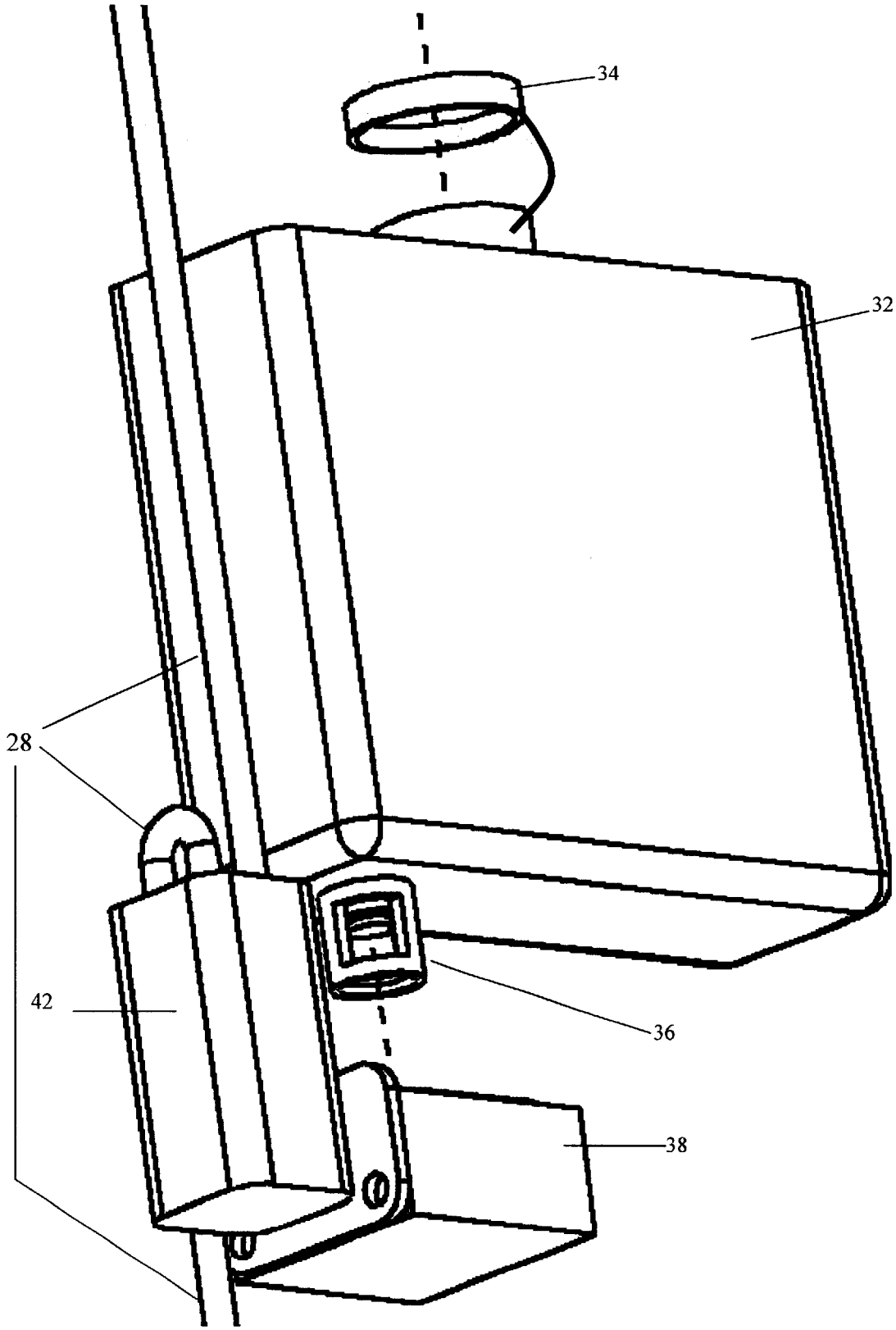
FIG. 6 is an exploded view of reservoir (embodiment 1 and 2)
Figures 7A, 7B:
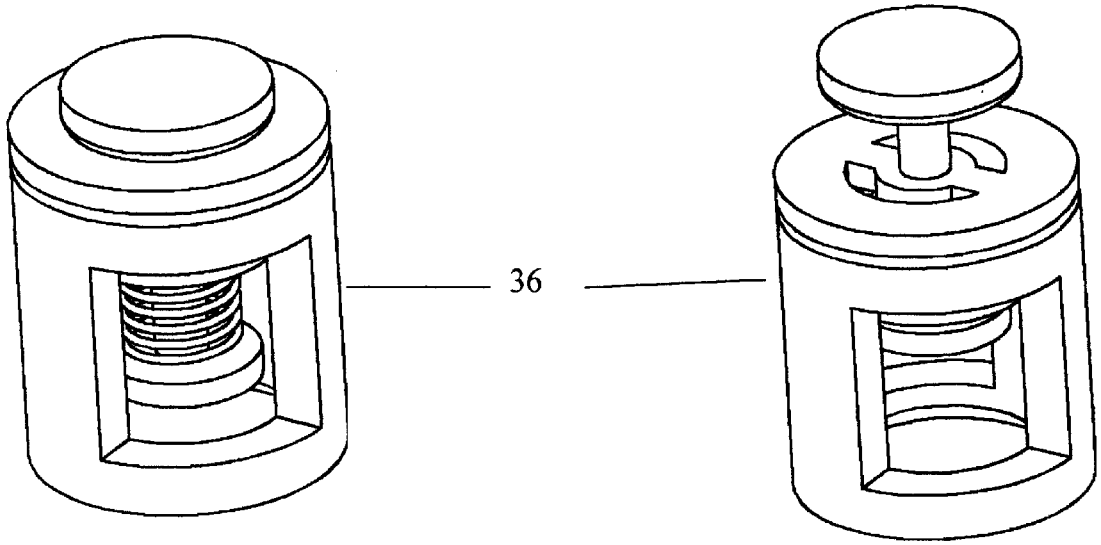
FIG. 7A is an oblique view of spring loaded check valve assembly in the closed position (embodiment 1, 2 and 3)
FIG. 7B is an oblique view of spring loaded check valve assembly in the open position (embodiment 1, 2 and 3)

FIGS. 5, 6 and 8 show fluid conduits in the form of tubing (28) that connects the reservoir receptacle to the pump and connects the pump (42) to the nozzle assemblies. The tubing which will be used across the hinge (8) is flexible in nature to facilitate opening the front of the main body (6). The remainder of the tubing will be preformed In FIG. 5B. an electric pump (42) is snap fit to the stationary main body housing below the reservoir. The pump is located below the reservoir to ensure the pump is automatically primed. The pump runs on DC voltage that is supplied by a rechargeable battery (44) system. The stationary housing is molded to provide sockets (46) to hold the batteries for the rechargeable battery system. These sockets provide positive caption to hold the battery or batteries in place and contain contacts to make low resistance electrical connections. Pre-assembled insulated stranded wire assemblies with connectors are used to connect the batteries to the pump and control board (56).

Figure 9:
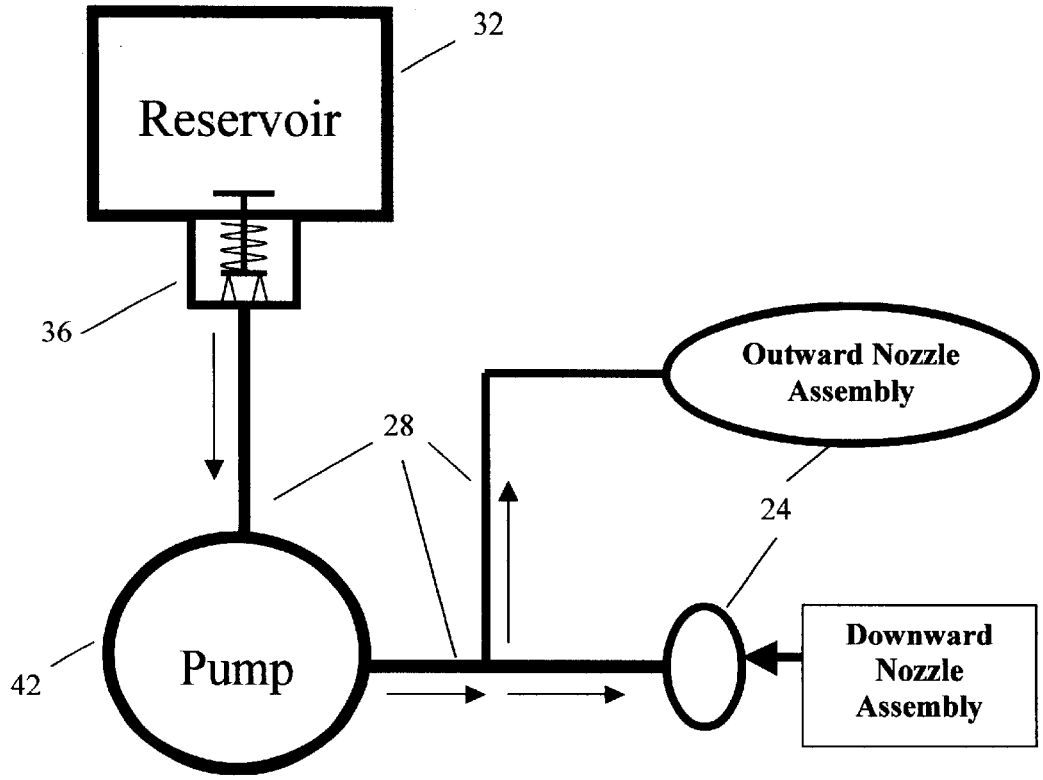
FIG. 9 is the fluid system block diagram (embodiment 1)

A block diagram of the fluid system of the cleaner is shown in FIG. 9. The fluid system consists of the refillable 32-ounce internal reservoir (32), electric pump (42), nozzle assemblies (24) and tubing (28). As previously discussed, the reservoir has a built in spring loaded check valve assembly (36) that seals to prevent fluid leakage when the reservoir is unseated and removed from the main body housing for refill. The tubing consists of rigid as well as flexible tubing as previously described to make interconnections between movable pieces. The nozzle assemblies are designed to provide optimum spray coverage and are adjustable to ensure adequate coverage for varying tub and shower configurations. All components heretofore discussed are constructed, or coated, with corrosion resistant materials.

Figure 10:
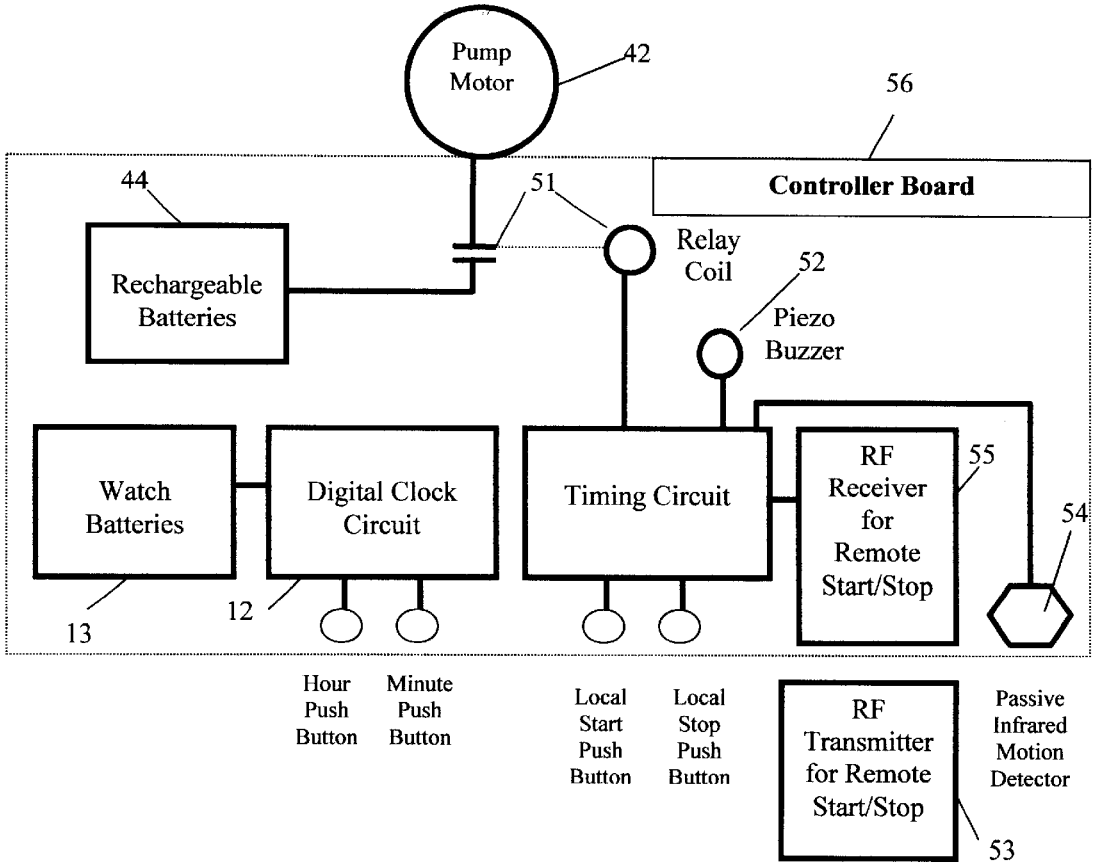
FIG. 10 is the electrical System block diagram (embodiment 1, 2 and 3)

The electrical block diagram of the cleaner is illustrated in FIG. 10. The electrical system consists of the operator panel, rechargeable battery (44) power supply, electric pump (42) motor, remote control transmitter (53), a piezo-electric buzzer (52), a relay mechanism to connect the rechargeable battery to the electric pump motor, operator panel containing push buttons (14) for local operator interface, a digital clock (12) powered by replaceable watch batteries (13), a timing circuit and a wireless receiver (55) tuned to the frequency of the wireless remote control transmitter (53).

In order to install the cleaner in a shower or bathtub, a user depresses the button on the spring-loaded latching mechanism (20) located on the rear of the cleaner allowing the adjustable mounting arm (18) to slide to the user defined height of the cleaner in the bathtub/shower. Once the height of the cleaner is adjusted the button on the spring-loaded latching mechanism is released thereby engaging an indentation (30) in the guide (58) and locking the adjustable mounting arm in place.

FIGS. 3A to 3C illustrates a quick snap attachment mechanism (48) located on the end of the adjustable mounting arm (18). The shower faucet pipe (50) is inserted into the opening of the quick snap attachment mechanism. The adjustable mounting arm is pushed upwards against the stationary faucet pipe until the quick snap attachment mechanism snaps into the locked position. At this point the cleaner can be released and the adjustable mounting arm suspends the cleaner from the shower/bathtub showerhead faucet pipe.

The refillable 32-ounce reservoir (32) can be removed from the cleaner by lifting the hinged front cover of the main body housing (6) and locking the front cover in the upward position via the locking hinges (8) located between the stationary part of the main housing (2) and the hinged front cover. By pulling out and up on the reservoir as shown in FIG. 5B, the user can unseat the reservoir from its seal. Once removed from the cleaner, the reservoir cap (34) can be removed allowing fluid to be poured into the reservoir. Once the reservoir is full and the cap replaced, the reservoir can be snap fitted back into the cleaner reestablishing a tight seal.

The operation of the cleaner can be activated by either depressing a start push button (14) on the operating panel (10) located on the front of the main body (6) or by pressing a start button on the wireless remote control transmitter (53). Depressing either of these two start buttons will initiate the spray sequence. Once initiated the user can stop the spray sequence if desired by pressing a stop button on the operating panel or remote control transmitter. The spray sequence begins with a period of time after pushing either start button and before spraying occurs to allow the user to get comfortably away from the bathtub/shower. During this period of time a repeating tone is sounded by the piezo buzzer (52) followed by a continuous tone to warn the user that the spray sequence has been initiated. At the end of the continuous tone the cleaner begins to spray fluid. The cleaner will spray for a period set by the user via the operator interface board.

When the cleaner depletes the reservoir (32) of fluid, the user may open the hinged front cover of the main body housing (6) and remove the reservoir for refill as discussed above. If the cleaner no longer has enough energy to operate, the user may open the front cover of the main body housing and remove the rechargeable batteries (44) as shown in FIG. 5B. The batteries are recharged in a separate battery charger. Once charged the batteries can be reinserted into the cleaner.

A passive infrared detector (54) is used to detect if anyone is in the shower or bathtub. If no one is detected, the spray sequence can be initiated to spray the bathtub/shower for the predetermined period. If someone is detected, the spray sequence cannot be initiated. If someone is detected by the passive infrared detectors during any portion of the spray or operating sequence, the sensor signals the timing circuitry. The timing circuitry will deenergize the relay coil (51) that controls the flow of energy to the DC electric pump motor (42) and the unit will stop discharging and the sequence will be aborted.

Figure 11A:
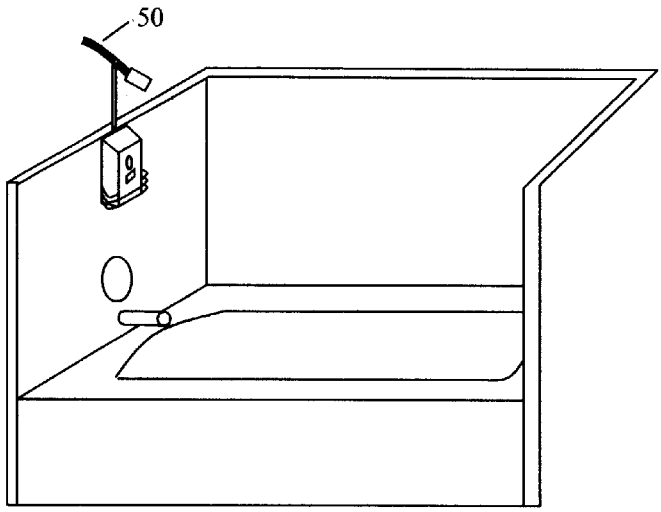
FIG. 11A is an oblique view of embodiment 1
Figure 11B:
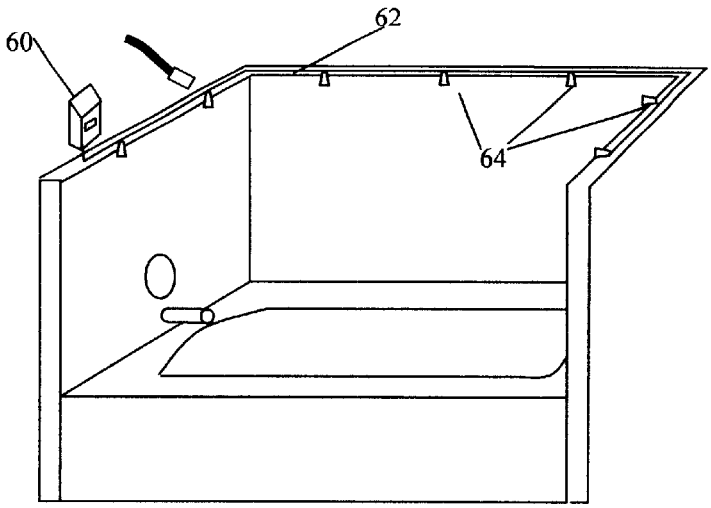
FIG. 11B is an oblique view of embodiment 2

A second embodiment includes the same components except for the mounting attachment and the nozzle assemblies as shown in FIG. 11B. The housing main body (60) is attached to a wall of the shower/bathtub via screws, adhesive means, suction means or suspension means. In this embodiment, the main body housing does not necessarily have to be mounted on the surface in which the spigot (50) penetrates. Instead of using nozzles attached to the housing, nozzles (64) are distributed along the upper perimeter of the shower/bathtub exterior surface. Flexible tubing (62) interconnects the distributed nozzles (64) to the outlet of the pump. The flexible tubing and nozzles are affixed by an adhesive, suction or suspension means.

Figure 11C:
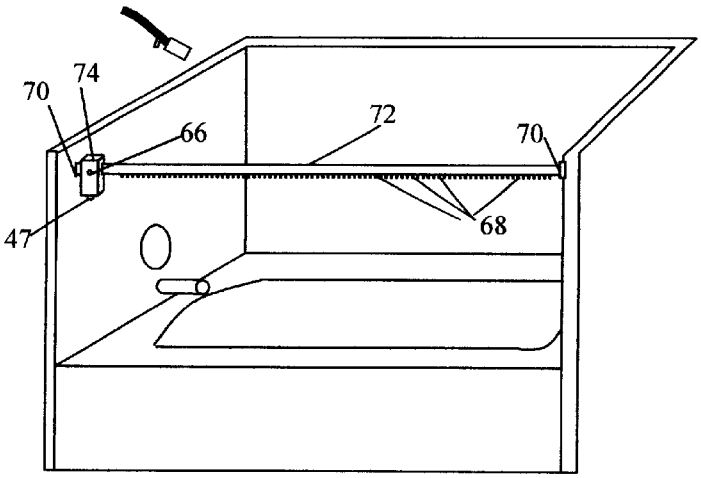
FIG. 11C is an oblique view of embodiment 3
Figure 12A:
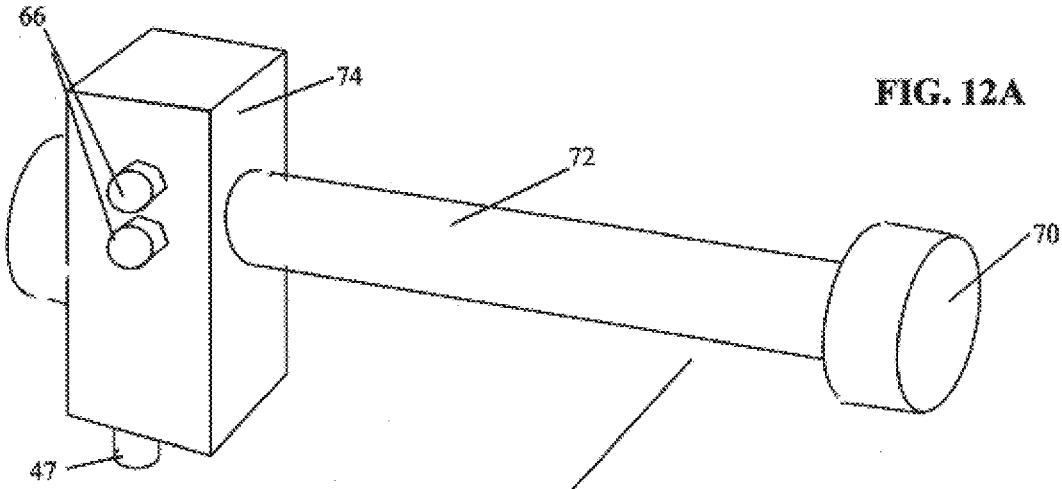
FIG. 12A is the front view of embodiment 3
Figure 12B:
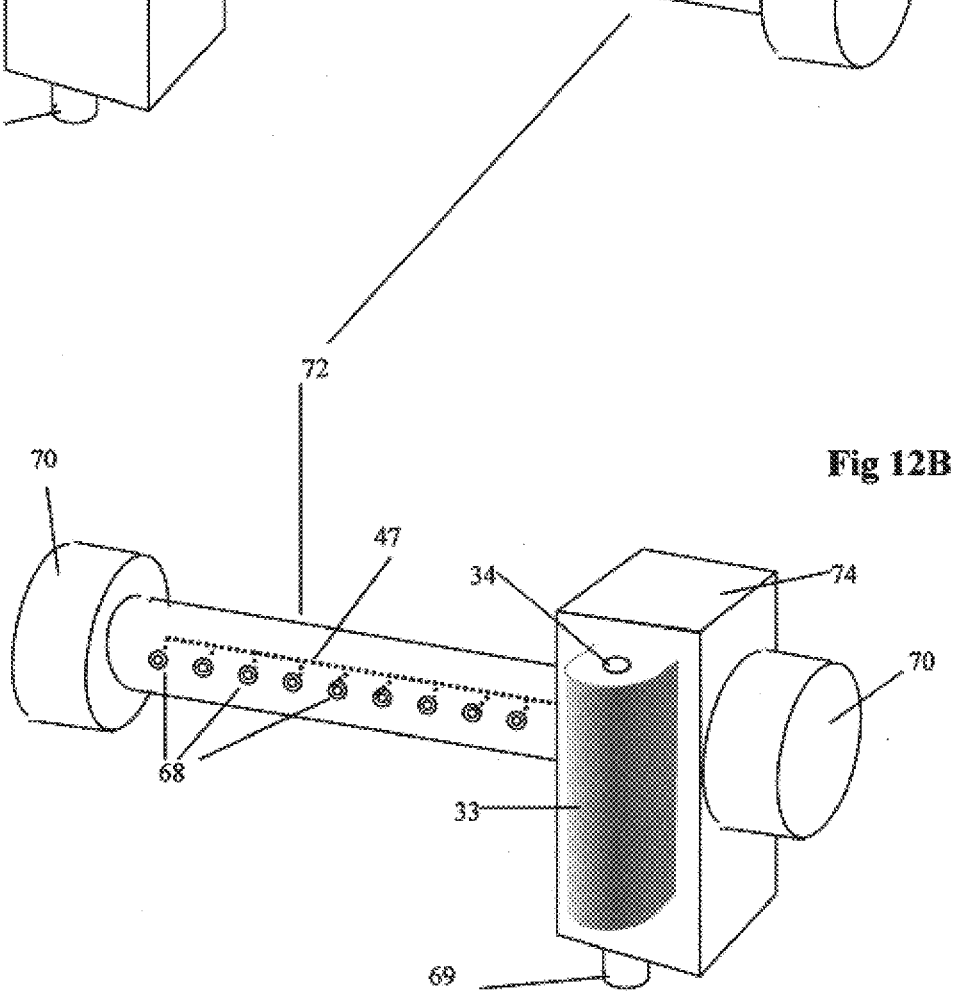
FIG. 12B is the rear view of embodiment 3

A third embodiment includes the same components discussed in the first embodiment except for the wire baskets (16), hinged front main body (6) and associated hinges (8), internal reservoir (32) and nozzle assemblies (24). Additionally, because this embodiment is integrated with a shower curtain rod, it does not have components associated with attaching the cleaner to a shower faucet. As shown in FIGS. 11C, 12A and 12B, the cleaner is integrated with a shower curtain rod (72). The main body housing (74) is located on one end of the rod. The main body housing (74) contains a reservoir (33), rechargeable battery (34) and pushbuttons (66); all accessible from the exterior of the housing. The nozzles (68) are located at set intervals axially down the rod. The nozzles are interconnected by a distribution manifold internal (69) to the rod. The manifold is interconnected to the outlet of the pump via flexible tubing. Adjustable end caps (70) are located at each end of the rod to accommodate varying shower and bathtub sizes. The end caps engage the rod via a threaded connection. The length of the rod may be increased or decreased by rotating the adjustable end caps accordingly.

Figure 13:
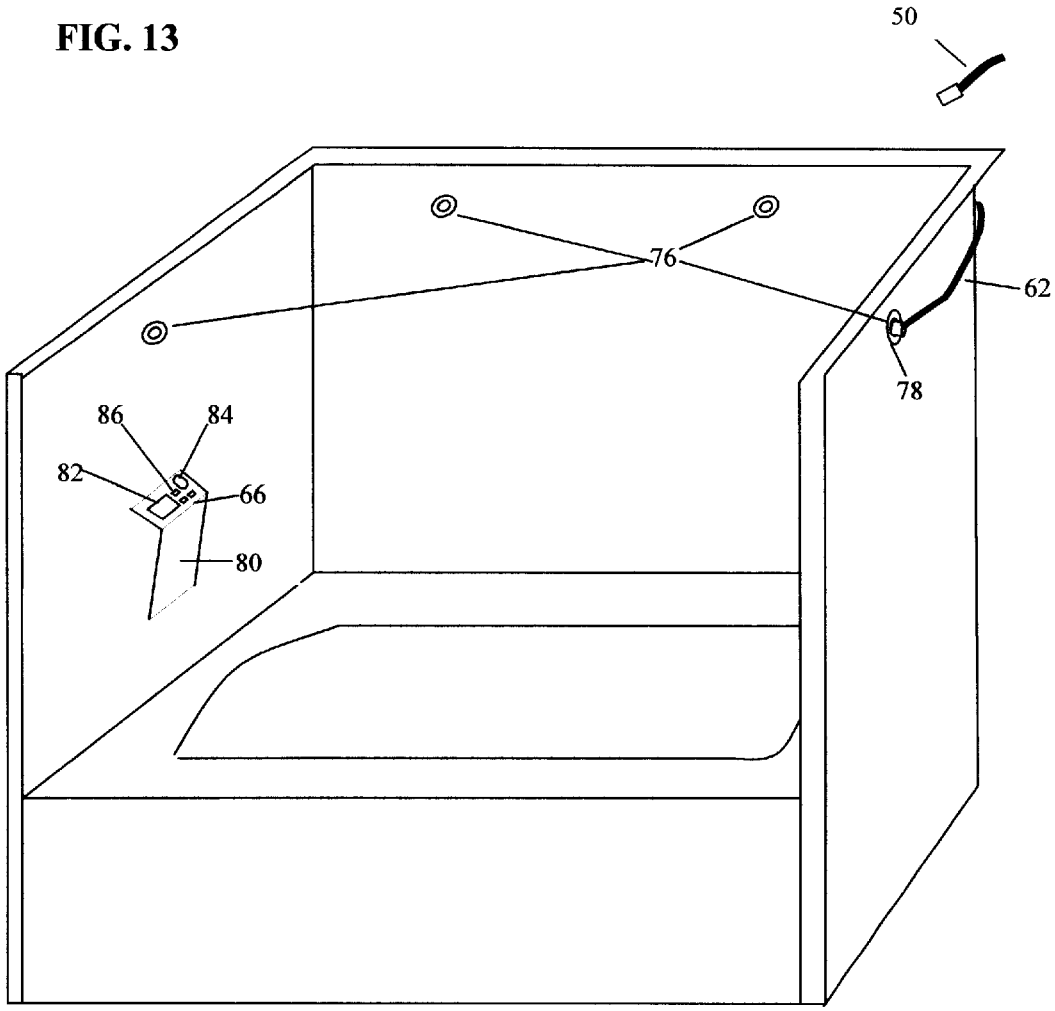
FIG. 13 is a view of embodiment 4 installed in tub/shower
Figure 14:
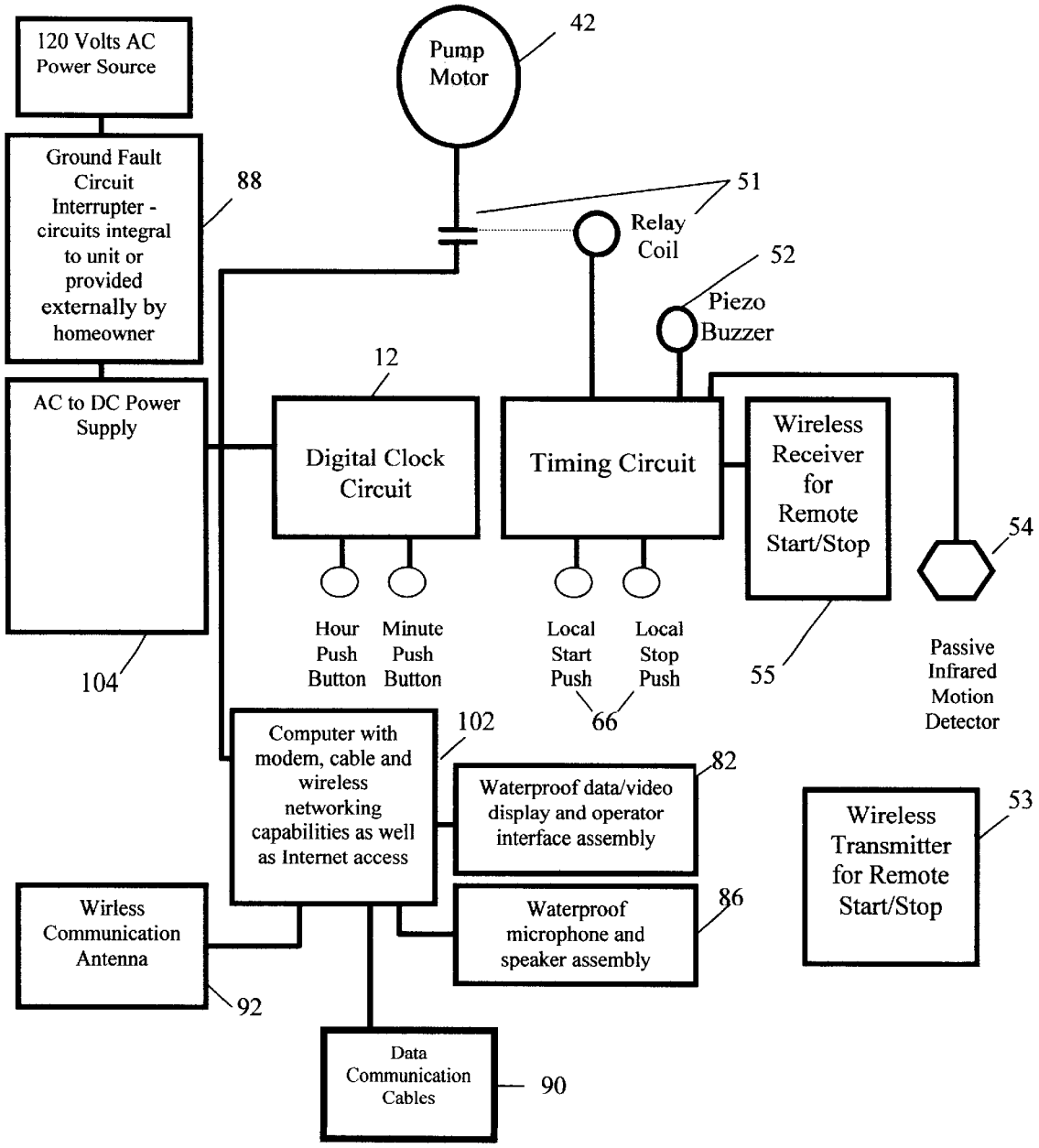
FIG. 14 is the electric block diagram of embodiment 4
Figure 16:
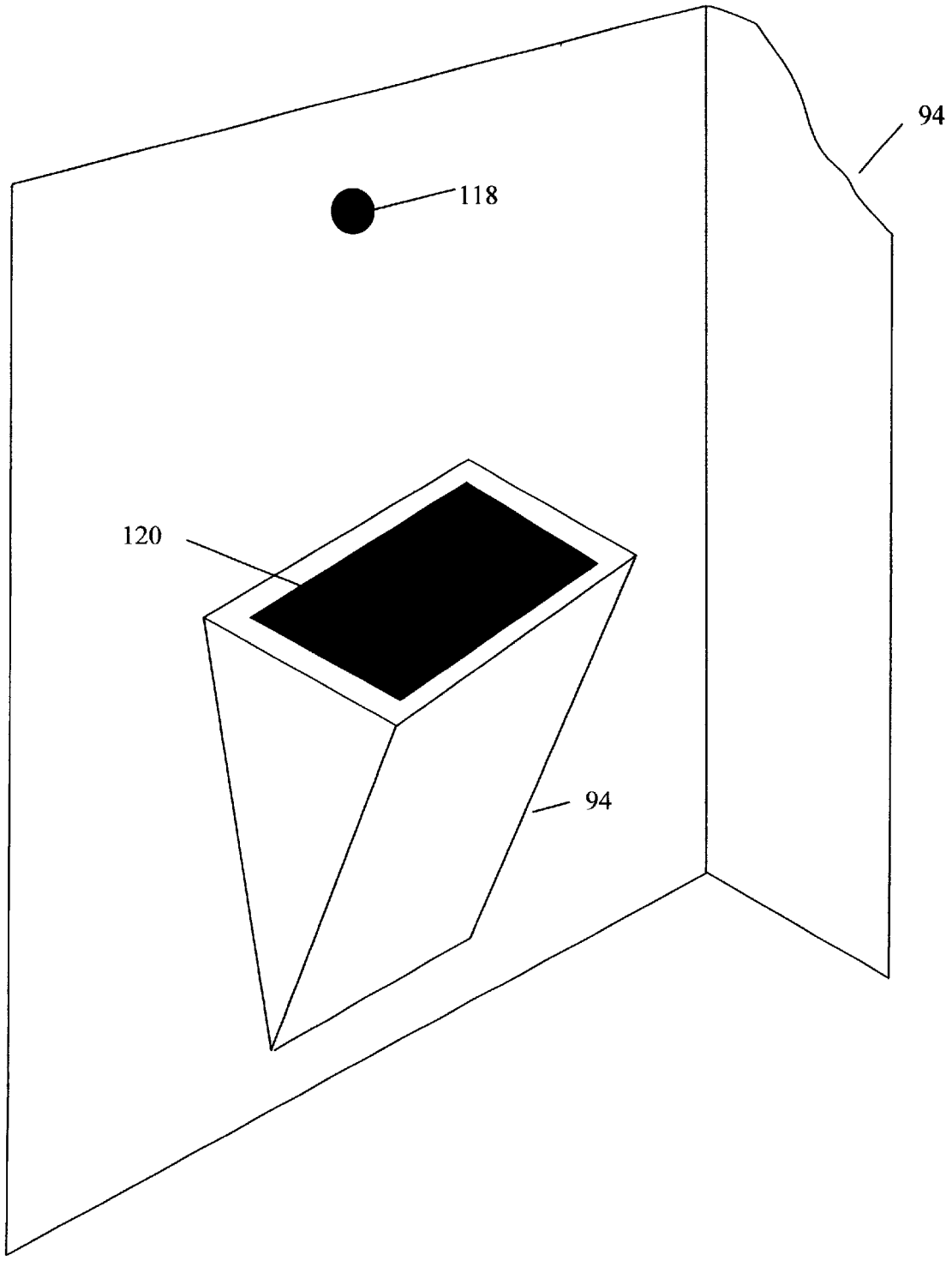
FIG. 16 is a perspective view of molded tub/shower surround with cutouts to accept shower cleaner (embodiment 4)
Figure 17:
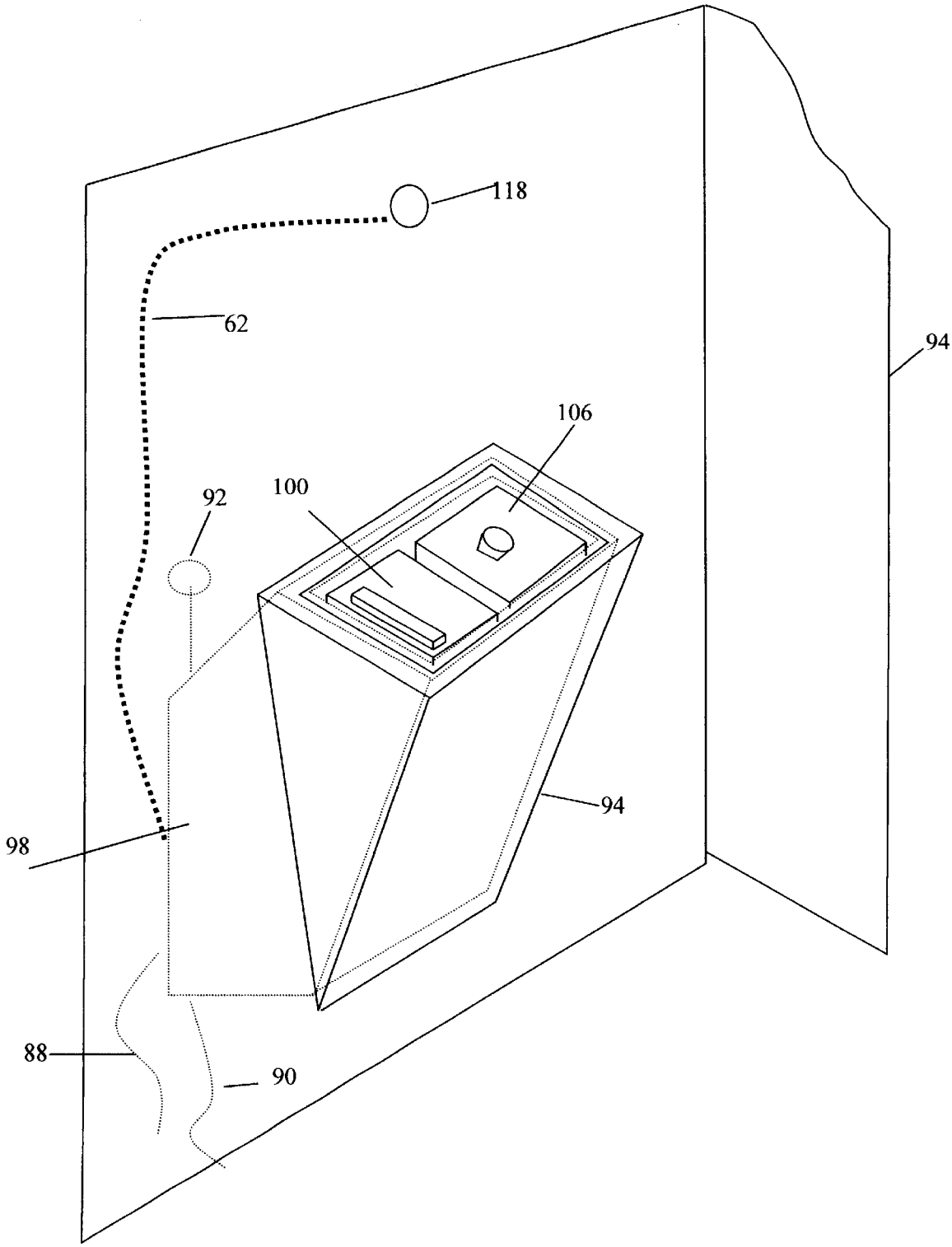
FIG. 17 is the phantom view of internal housing mounted behind the molded tub/shower surrounded (embodiment 4)
Figure 18:
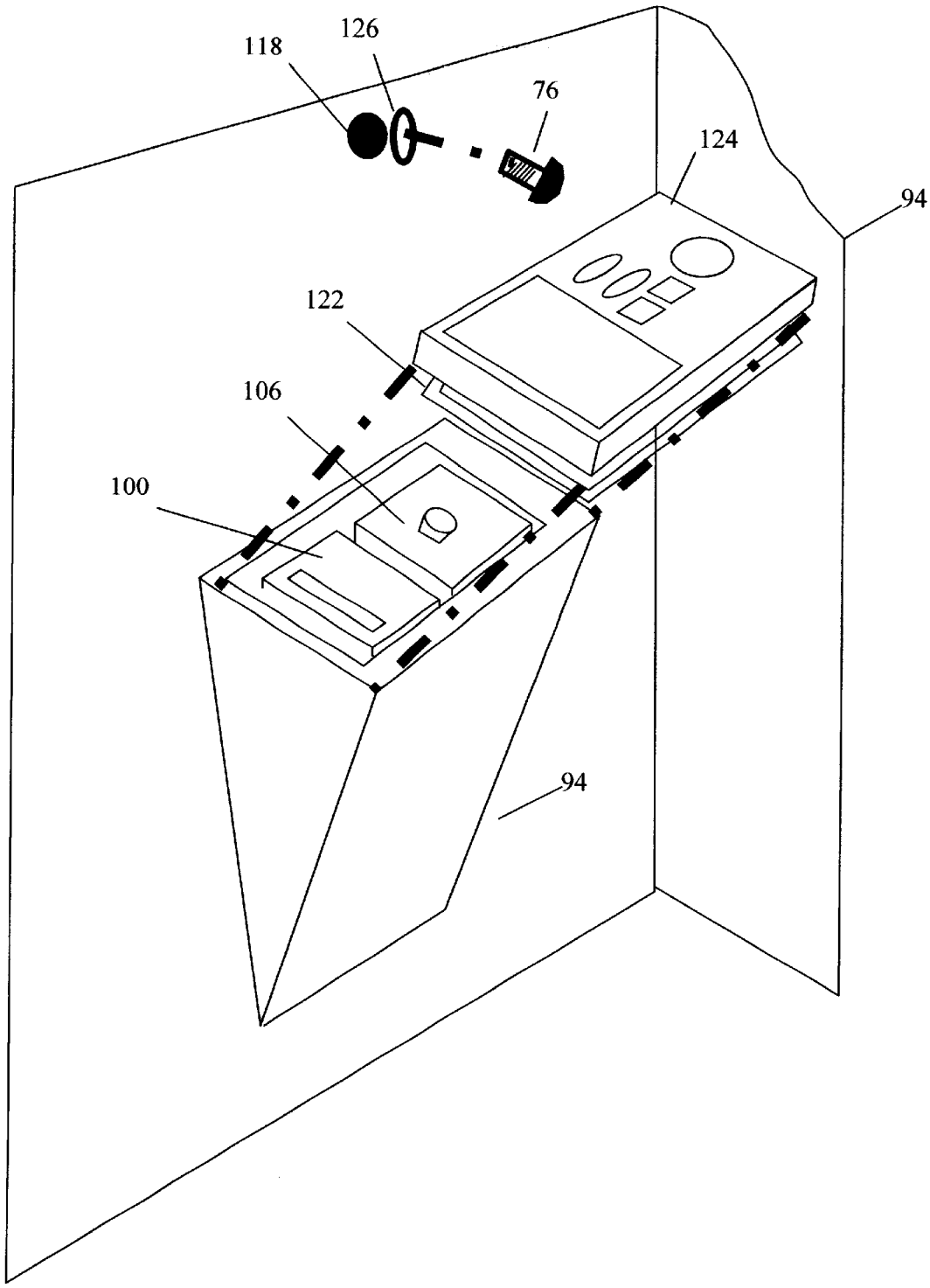
FIG. 18 is an exploded view of multi-media operator interface panel, gasketing, bulkhead feed-through nozzle assembly and the molded tub/shower surround (embodiment 4)
Figure 19:
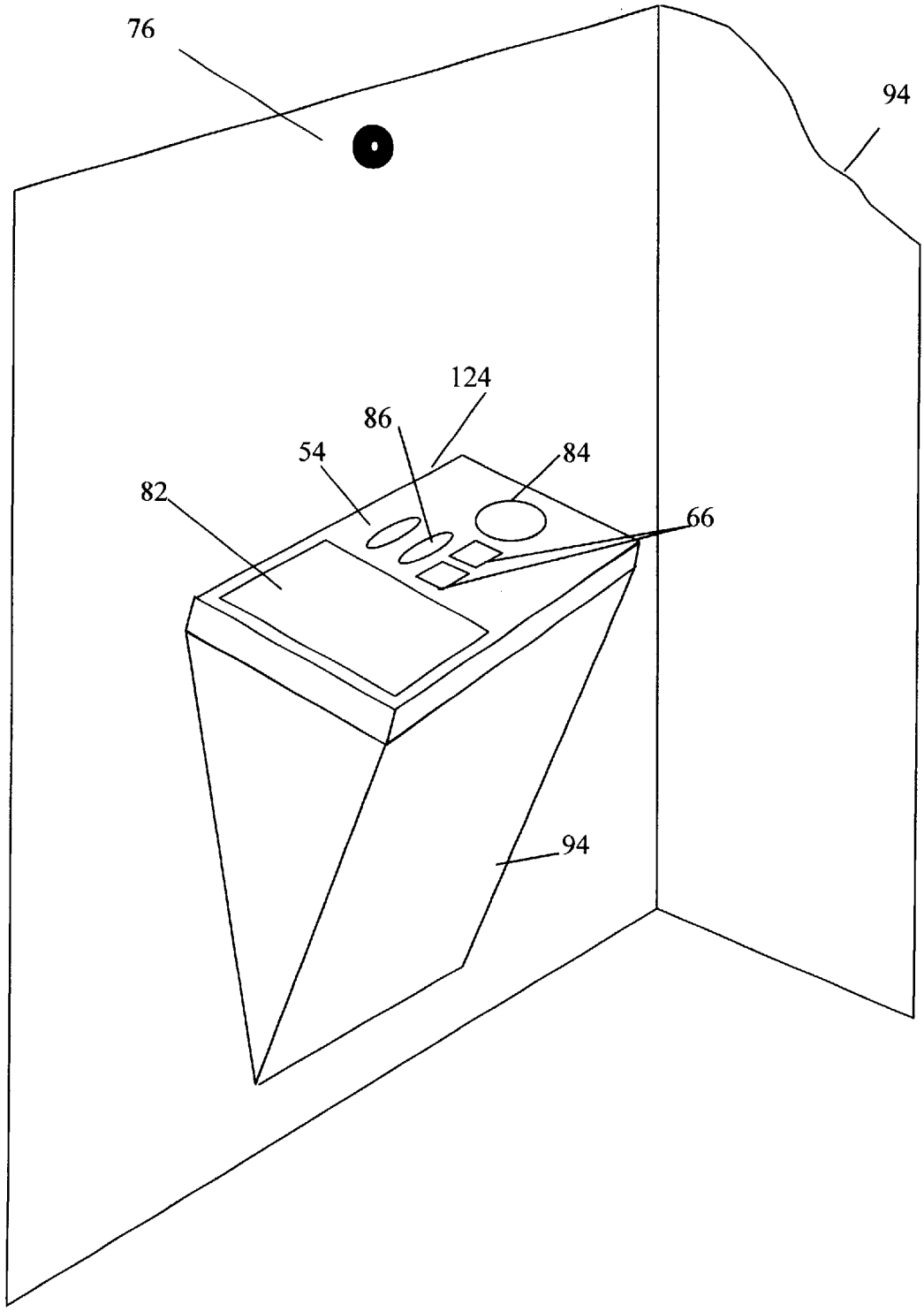
FIG. 19 is the oblique view of the fully installed the automatic shower and tub cleaner (embodiment 4)
Figure 20:
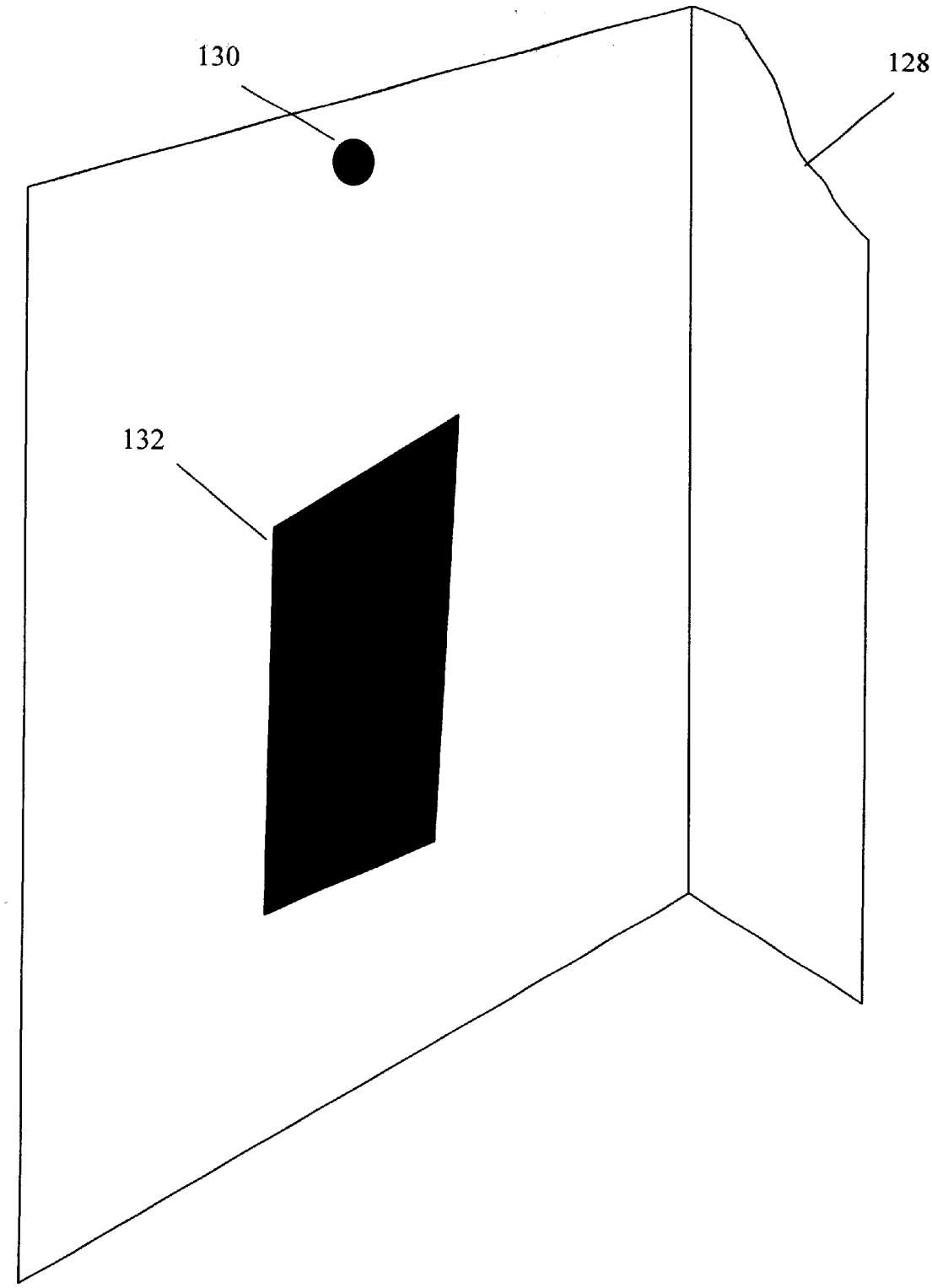
FIG. 20 is a perspective view of cut outs necessary to be made in existing tub/shower surround in the field in order to retrofit embodiment 5 of the shower/tub cleaner
Figure 21:
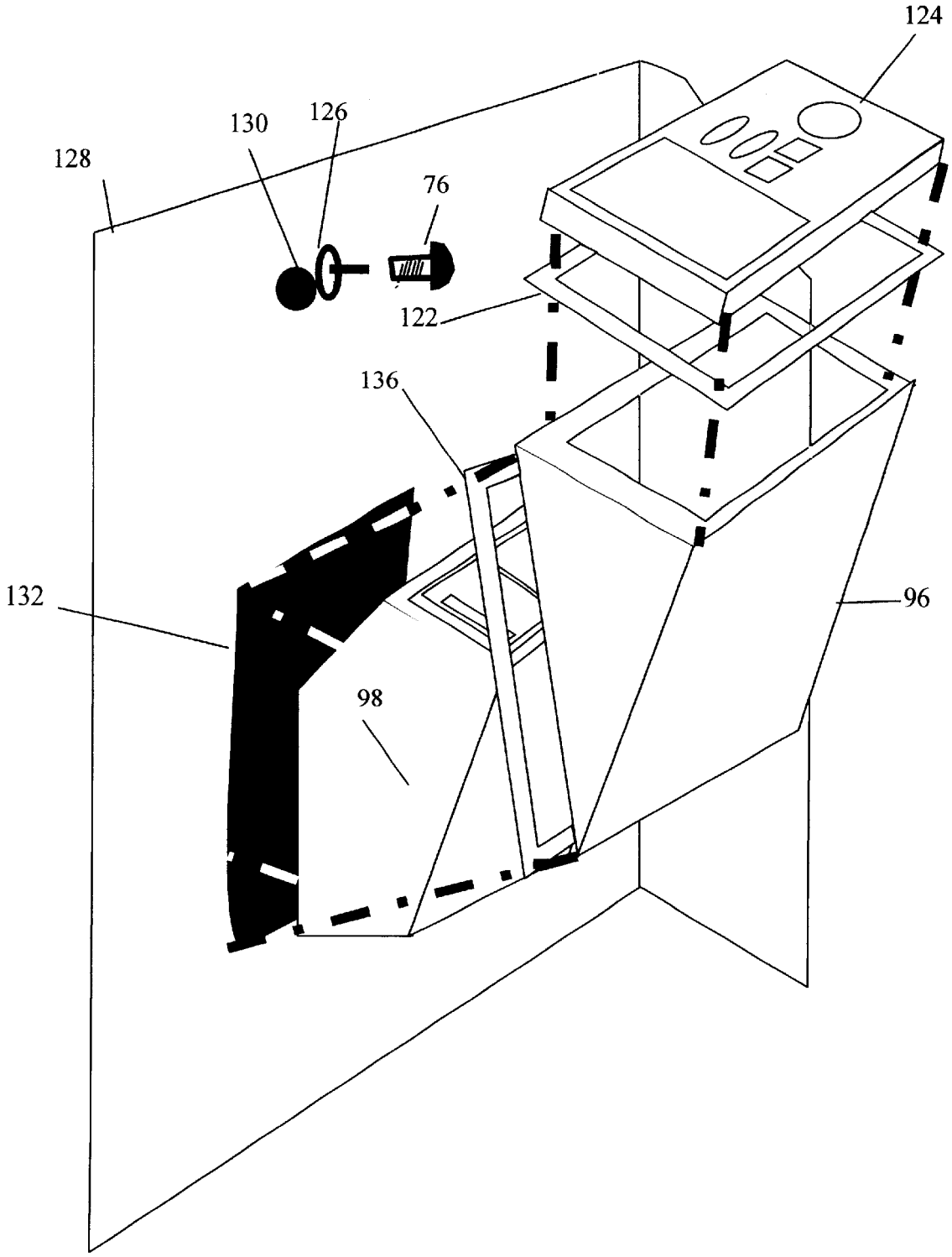
FIG. 21 is an exploded view of multi-media operator interface, internal housing, sloped operator interface section, gasketing and existing tub/shower surround with field installed cutouts for retrofitting embodiment 5 of the cleaner to an existing shower/tub

In a fourth embodiment, components are installed as integral parts of a new bathtub/shower installation (see FIG. 13). Unlike the previous embodiments, this embodiment minimizes the intrusiveness of the automatic shower cleaner by hiding the majority of its components. As shown in FIG. 13, the only components visible to the user are the distributed bulkhead feed through nozzles (76) and the multimedia interface panel (124); all other components are hidden behind the tub/shower surround. FIG. 14 provides an overview of the electrical block diagram of the embodiment. This embodiment has a pump motor (42), relay contact and coil (51), wireless remote transmitter (53) and wireless receiver (55), passive infrared motion detector (54), digital clock (12) and local stop and start pushbuttons (66). Since the majority of this embodiment is located behind the tub/shower surround it is feasible and safe to hard wire the unit to a branch circuit in the dwelling. This eliminates the need for rechargeable batteries used as the power source in previous embodiments. The electrical power is provided by a branch circuit with ground fault circuit interruption capabilities (88). This circuit provides 120 volts AC to the AC to DC power supply (104). The power supply provides low voltage DC electrical power to all the loads in embodiment 4. Some of the new loads in embodiment 4 not found in embodiments 1, 2, or 3 are a computer (102), waterproof microphone/speaker assembly (86) and waterproof data/video display/interface with touch sensitive screens (82). Data/communication connections via copper wire, optical fibers or a wireless medium (antenna (92)) are also included in this embodiment. The computer with its display drivers, modems, networking cards (102) are housed in a chassis (100) with the AC to DC power supply (104). The chassis has connectors on each end of it to provide electrical connections between itself, the multimedia operator interface panel as well as the electrical power branch circuit (88), the data/communication wires (90), and antenna (92) via the internal antenna wiring (114). A stationary reservoir (134) is coupled with a pump (110). The reservoir/pump module's pump (110) is located underneath the stationary reservoir. The opening of the reservoir is elongated with a reservoir neck (108) to engage the multi-media operator interface panel's (124) reservoir fill port (84). Flexible tubing (62) connects the reservoir/pump module to the distributed bulkhead feed through nozzles (76) behind the tub/shower surround as shown in FIGS. 13 and 20. The chassis (100) and reservoir/pump module (106) are supported and protected by the internal housing (98) as shown in FIG.17. As shown in FIG. 16, the tub/shower surround (94) will be molded in the factory to accept the internal housing (98). The shape of the mold will be contoured to avoid areas where water will pool and/or provides conditions for breeding bacteria or mold. The tub/shower surround will come with cutouts (118) and (120) to facilitate installation of embodiment 4 as shown in FIG. 16. The multi-media operator interface panel contains the start/stop pushbuttons (66), reservoir fill port (84), passive infrared motion detector (54), waterproof speaker/microphone (86) and the waterproof data and video display/interface with touch sensitive screen capabilities (82) as shown in FIG. 21. This panel is secured to the molded tub/shower surround via a waterproof clamping mechanism and a gasket (122) as shown in FIG. 18. A perspective view of the embodiment 4 is shown in FIG. 19.

Embodiment 5 is nearly identical to embodiment 4, however, embodiment 5 is focused on retrofit applications where the automatic tub/shower cleaner will be back fit into an existing tub/shower. Rather than having a molded tub/shower surround as in embodiment 4, embodiment 5 uses a sloped interface section (96). As shown in FIG. 20, the existing tub/shower surround (128) must be modified in the field by creating cut outs (130) and (132) for the bulkhead feed through nozzles (76) and the internal housing (98), respectively as shown on FIG. 21. The cutout in the existing tub/shower surround for the internal housing is large enough to pass the internal housing through from the user's side of the tub/shower surround (128) as shown in FIG. 21. Once the internal housing is in place, a sloped operator interface section (96) is affixed to the tub/shower surround (128) using gasketing (136) and watertight fasteners as shown in FIG. 21. The remaining components are identical to embodiment 4 in look, character, quantity and operation.

Operation of embodiments 2, 3, 4 and 5 are similar to that of embodiment 1 in that fluid stored in the reservoir (32) will be discharged via nozzles initiated by either depressing a start push button (66) on the unit's operator interface or by remote activation via a wireless transmitter (55). The major operational differences among the five embodiments are in how the units are installed.

Embodiment 2 is similar to embodiment 1 in size and shape, however, embodiment 2's main body (60) can be located anywhere in the tub and shower. The main body (60) can be affixed to the wall surface using fastener means as opposed to embodiment 1 which is supported from the shower faucet (50). Additionally, flexible distribution tubing (62) and distributed nozzles (64) are installed around the perimeter of the tub or shower using a fastening mechanism. The operator gains access to the internals of the main body by lifting the front cover upwards locking into position. The battery and reservoir can be removed with the front cover open just as in embodiment 1. Upon activation, the electric pump is energized after a timing sequence and the fluid is transported to the distributed perimeter nozzles (64) via the flexible distribution tubing (62) affixed to the perimeter of the tub/shower at which time the shower/tub surfaces are coated with the cleaning fluid. The distributed nozzles (64) may be located where needed to obtain acceptable spray coverage of the tub/shower by cutting the flexible distribution tubing (62) to desired length. As in embodiment 1, activation may be via a local start and stop pushbuttons (66) or a wireless remote transmitter (53). Discharge of the cleaning fluid will be halted if the passive infrared detector (54) senses motion.

Embodiment 3 is installed much the same way that a shower curtain rod is installed. The installer places the cleaner between the two opposing walls of the tub/shower as shown in FIG. 11*c*. The cleaner's length is adjusted by rotating the adjustable end caps (70). When rotated the end caps (70) will extend pushing against the walls. The end caps (70) are rotated until the compressional forces overcome the weight of the cleaner, thereby suspending the cleaner between the opposing walls. A shower curtain may be hung from the cleaner using sliding hangers or the cleaner can be located in parallel to the shower curtain. Unlike embodiment 1, the operator need not lift a front cover to gain access to the waterproof DC battery and waterproof socket (47) or the external reservoir (33). The external reservoir (33) and waterproof DC battery and waterproof socket (47) are directly accessible from the exterior of the cleaner. The rechargeable battery is inserted into watertight socket (47) located on the bottom of the unit. The external reservoir (33) can be removed from its socket for refilling. As in embodiment 1, a spring load check valve is located on the bottom of the external reservoir (33) preventing fluid from being discharged while the reservoir is removed from its socket. Similarly, the battery may be removed from the unit for recharging. Upon activation, the electric pump (42) is energized after a timing sequence and the fluid is transported to the axially distributed nozzles (68) via the internal distribution manifold (69) at which time the shower/tub surfaces are coated with the cleaning fluid. As in embodiment 1, activation may be via the local start and stop pushbuttons (66) or a wireless remote transmitter (53).

Figure 15:
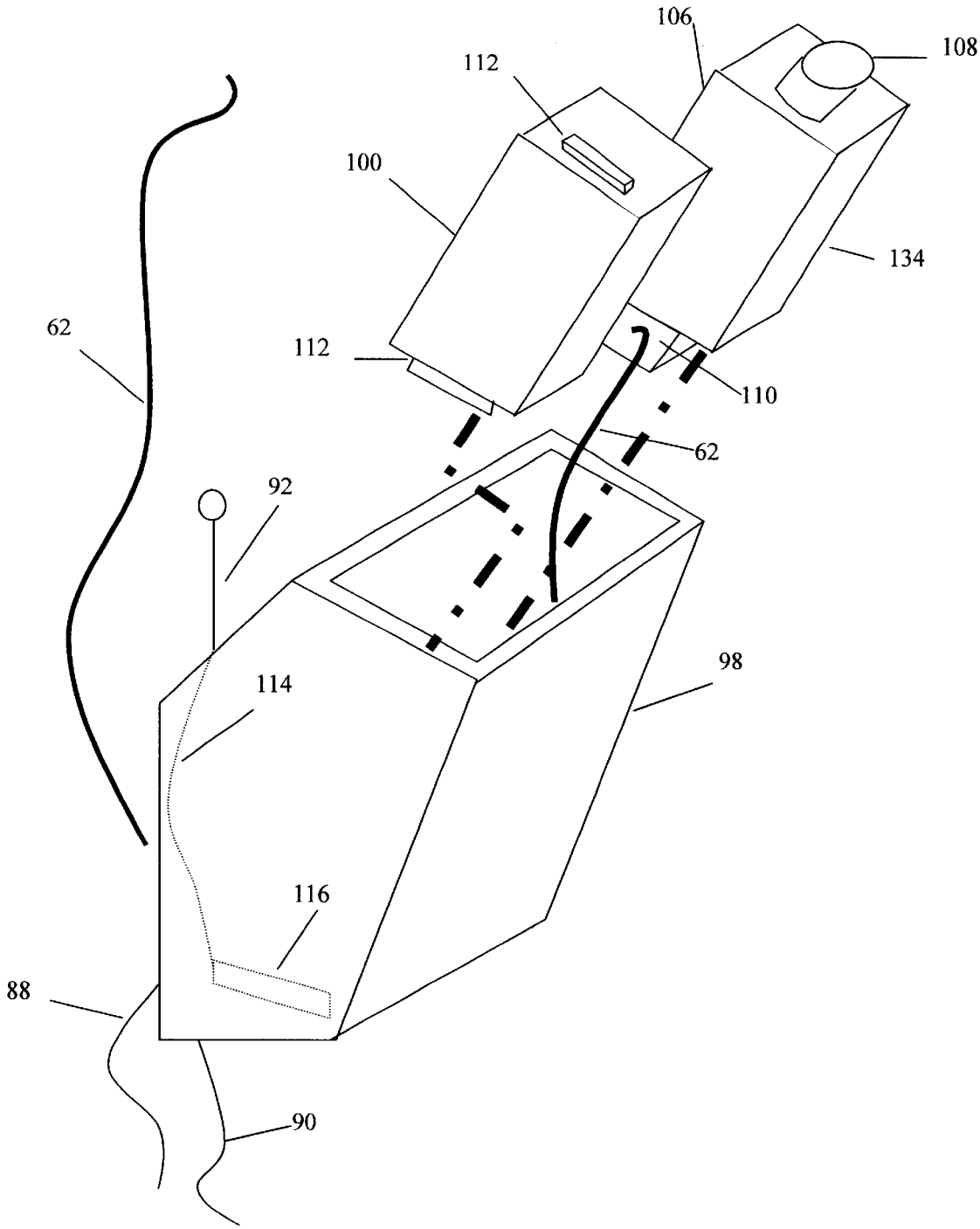
FIG. 15 is an exploded view of embodiment 4's internal housing, power supply/computer chassis and reservoir/pump module

Embodiment 4 is assembled in the factory vise the field. In doing so the tub/shower manufacturer will mold and cut the tub/shower surround (94) to accommodate the internal housing (98) and the bulkhead feed through nozzles (76). The internal housing (98) is affixed to the molded tub/shower surround (94) and then the reservoir/pump module (106) as well as the computer chassis (100) is inserted through the installed cutout for access to internal housing components (120) as shown in FIGS. 17, 18 and 19. The bulkhead feed through nozzles (76) are installed around the perimeter of the molded tub/shower surround (94) through the cut outs (118) as shown in FIGS. 13 and 18. The nozzles (76) are interconnected to each other and the reservoir/pump module's pump (110) via the flexible distribution tubing (62). The tubing is routed behind the tub/shower surround as shown in FIGS. 13, 19 and 20. The multi-media operator interface panel (124) is affixed using a gasket (122) as shown in FIG. 18. However, the multi-media operator interface panel can be removed allowing access to the internal housing to allow for preventive maintain and replacement of parts without requiring access to behind the tub/shower surround. The tub/shower installer must connect 120 volt AC branch circuit cables to the cleaner's internal housing (98) and internal housing connector (116) as shown in FIG. 15. The tub installer also must connect the data/communication cables (90) if a copper or optical fiber based communication link is desired to interface with the computer (102). The installer may also install a wireless communication antenna (92) on the internal housing (98) if a wireless communication link to the computer (102) is desirable as shown in FIGS. 15 and 17. The operation of Embodiment 4 can be broken down into two main functions; cleaner fluid dispenser and multi-media communications. The dispensing of the cleaning fluid is similar to the previous embodiments in that activation may be via a local start and stop pushbuttons (66) or a wireless remote transmitter (53). Upon activation, the electric puns (42) is energized after a timing sequence and fluid is transported to the bulkhead feed through nozzles (76) via the flexible distribution tubing (62) at which time the shower/tub surfaces are coated with the cleaning fluid. Discharge of the cleaning fluid will be halted if the passive infrared detector (54) senses motion. When the cleaning fluid is consumed, the reservoir may be refilled by opening the reservoir fill port (84) located on the multi-media operator interface panel (124) and transferring fluid from a storage container to the reservoir through the fill port (84). The multi-media communications are provided by the computer (102), waterproof data and video display/interface (82) and communications links; copper and optical fiber based (90) or wireless via the antenna (92). The user may interface with the computer (102) via the touch sensitive waterproof data and video display/interface (82) or via the waterproof microphone/speaker (86). By either touching the screen of the data and video display/interface (82) or providing voice commands via the microphone (86) recognized by the computer (102), the operator can execute/run software stored on the computer (102). As such the operator can gain access to local area networks, the Internet, television and radio as well as both copper based and wireless phone exchanges. In doing so, the user can make phone calls, listen to voice mail, read email, organize/review schedules, trade stocks and search the Internet just as any other personal computing device. This embodiment does not use rechargeable DC batteries for power. 120-volt AC electrical power is isolated and stepped down to low voltage DC electrical power. This power is than distributed to all other loads such as the computer (102), digital clock and timing circuit (12) as shown in FIG. 16. This provides isolated low voltage DC power while minimizing the risk of electric shock to the operator.

Embodiment 5 operates identically to embodiment 4 in regards to dispensing cleaning fluid and multi-media communications. The difference between embodiment 4 and 5 is that embodiment 5 is targeted at retrofitting the cleaner to an existing tub/shower surround (128) in a manner that minimizes visual intrusiveness. The existing tub/shower surround (128) is modified by cutting openings (130 & 132) in the surround to allow the placement of the internal housing (98) and the bulkhead feed through nozzles (78) as shown in FIG. 21. The cutout (132) is adequate size to allow affixing the internal housing (98) from the tub side of the surround without access to the rear of the surround as shown in FIG. 22. Prior to installing the internal housing (98), the installer must install and connect the 120-volt AC branch circuit (88), the data/communication cables (90), and the flexible distribution tubing (62) to the internal housing connector (116) and pump (110). Once the internal housing (98) is in place, the sloped operator section (96) is attached to the existing tub/shower surround (128) as shown in FIG. 22 using a gasket (122) to provide a watertight seal. The multimedia communication operator interface panel (124) is installed using a watertight gasket (122) as well as shown in FIG. 22. This embodiment does not use rechargeable DC batteries for power. 120-volt AC electrical power is isolated and stepped down to low voltage DC electrical power. This power is than distributed to all other loads such as the computer (102), digital clock and timing circuit (12) as shown in FIG. 14. This provides isolated low voltage DC power while minimizing the risk of electric shock to the operator.

What is claimed is:

1. An automatic cleaning device for cleaning a shower or bathtub enclosure comprising:

a means for securing the cleaning device within the shower or bathtub enclosure, a main body consisting of a watertight housing supported by a frame wherein said housing has a single side that is hinged such that said single side that is hinged can be opened thereby allowing access to the interior of said housing, a removable reservoir wherein said reservoir contains a liquid cleaning solution, a nozzle assembly wherein said nozzle assembly directs said liquid cleaning solution towards the interior surfaces of said shower or bathtub enclosure, an electric powered pump, a fluid conduit means transporting the liquid cleaning solution from the reservoir to the pump, and a second fluid conduit means transporting the liquid cleaning solution from the pump to the nozzle assembly.

2. The invention as set forth in claim 1, further comprising:

an operating panel located on one outside surface of the main body, a clock, means located on the exterior of said operating panel whereby a person can communicate with the device to activate or deactivate operation of the device, means located on the exterior of said operating panel whereby the clock can be adjusted, a timing circuit wherein said timing circuit will delay the device spraying liquid cleaning solution for a pre-programmed period of time and said timing circuit will allow the duration of the device spraying liquid cleaning solution to be adjusted, a buzzer wherein said buzzer will sound during the pre-programmed period of time before the device initiates spraying, and a removable and rechargeable battery system wherein said battery system provides direct current voltage to said pump.

3. The invention as set forth in claim 2 wherein said nozzle assembly can be adjusted to discharge said liquid cleaning solution to provide maximum surface coverage depending on shower or bathtub dimensions.

4. The invention as set forth in claim 3 wherein said frame is constructed not only to support the main body of the device, but also to provide means for storing toiletries adjacent to the exterior of the main body.

5. The invention as set forth in claim 4 wherein the means for securing the cleaning device includes a mounting arm attached to the top of the main body wherein said mounting arm is adjustable in length and possesses means to securely fasten said mounting arm to a shower spigot.

6. The invention as set forth in claim 5 wherein the mounting arm is constructed of flexible material thereby allowing the main body to rest immediately adjacent to and in contact with the one exterior surface of the shower or bathtub enclosure through which the shower spigot or shower head piping travels.

7. The invention as set forth in claim 6, further comprising a second nozzle assembly wherein said second nozzle assembly sprays the liquid cleaning solution on the one exterior surface of the shower or bathtub enclosure through which the shower spigot or shower head piping travels.

8. The invention as set forth in claim 7 wherein the reservoir is constructed of translucent plastic thereby allowing a person to view an amount of said liquid cleaning solution remaining in said reservoir.

9. The invention as set forth in claim 8 further comprising a spring loaded valve assembly located immediately underneath the reservoir wherein said spring loaded valve assembly automatically shuts when said reservoir is removed from the main body thereby preventing leakage of liquid cleaning solution from said reservoir.

10. The invention as set forth in claim 9, wherein the interior of said housing is constructed to align, store, and support said reservoir, said battery system, said nozzle assembly, said second nozzle assembly, said pump, said fluid conduit means and said second fluid conduit means.

11. The invention as set forth in claim 10, further comprising a means for remote activation or deactivation of said device.

12. The invention as set forth in claim 11, further comprising means to detect the presence of a person within the shower or bathtub enclosure and if such presence is detected while the device is spraying liquid cleaning solution or during a pre-programned period of time before the device initiates spraying the device is deactivated.

13. The invention as set forth in claim 2 wherein said nozzle assembly is comprised of a plurality of nozzles located along the perimeter of the exterior surfaces of said shower or bathtub enclosure.

14. The invention as set forth in claim 13 wherein the reservoir is constructed of translucent plastic thereby allowing a person to view an amount of said liquid cleaning solution remaining in said reservoir and further comprising a spring loaded valve assembly located immediately underneath the reservoir wherein said spring loaded valve assembly automatically shuts when said reservoir is removed from the main body thereby preventing leakage of liquid cleaning solution from said reservoir.

15. The invention as set forth in claim 14 further comprising a means for remote activation of deactivation of said device and a means to detect the presence of a person within the shower or bathtub enclosure and if such presence is detected while the device is spraying liquid cleaning solution or during a pre-programmed period of time before the device initiates spraying the device is deactivated.

* * * * *